US007812243B2

(12) United States Patent
Celi et al.

(10) Patent No.: US 7,812,243 B2
(45) **Date of Patent: *Oct. 12, 2010**

(54) STRINGED INSTRUMENT WITH EMBEDDED DSP MODELING FOR MODELING ACOUSTIC STRINGED INSTRUMENTS

(75) Inventors: Peter J. Celi, Agoura Hills, CA (US); Michel A. Doidic, Westlake Village, CA (US); Marcus Ryle, Westlake Village, CA (US)

(73) Assignee: Line 6, Inc., Calabasas, CA (US)

( * ) Notice: Subject to any disclaimer, the term of this patent is extended or adjusted under 35 U.S.C. 154(b) by 599 days.

This patent is subject to a terminal disclaimer.

(21) Appl. No.: 11/321,395

(22) Filed: Dec. 29, 2005

(65) Prior Publication Data

US 2006/0101987 A1 May 18, 2006

Related U.S. Application Data

(63) Continuation of application No. 10/933,653, filed on Sep. 3, 2004, now Pat. No. 7,279,631, which is a continuation-in-part of application No. 10/197,363, filed on Jul. 16, 2002, now Pat. No. 6,787,690.

(51) Int. Cl.
*G10H 3/00* (2006.01)

(52) U.S. Cl. ..... 84/723; 84/725; 84/726; 84/730; 84/731

(58) Field of Classification Search ..... None
See application file for complete search history.

(56) References Cited

U.S. PATENT DOCUMENTS 5,025,703 A 6/1991 Iba et al.

(Continued)

FOREIGN PATENT DOCUMENTS

JP 10-133657 5/1998

(Continued)

OTHER PUBLICATIONS

M. Karjalainen, H. Penttinen & V. Valmaki, More acoustic sounding timbre from guitar pickups; Proceedings of the 2nd COST G 6 Workshop on Digital Audio Effects (DAFx99), NTNU, Trodheim, Dec. 9-11, 1999.

(Continued)

*Primary Examiner*—Marlon T Fletcher
(74) *Attorney, Agent, or Firm*—Blakely, Sokoloff, Taylor & Zafman LLP

(57) ABSTRACT

Disclosed is a stringed instrument with embedded DSP modeling capabilities to model an acoustic stringed instrument. The stringed instrument has a body and a plurality of strings and each of the plurality of strings is respectively coupled to a pickup to detect a vibration signal for each string. An A/D converter converts the detected vibration signal of a string into a digital string vibration signal. A DSP is located within the body of the stringed instrument to process the digital string vibration signal and to implement an acoustic modeling system to process the digital string vibration signal in order to emulate a corresponding string tone of one of a plurality of selectable acoustic stringed instruments. Acoustic modeling includes acoustic string and body modeling, microphone placement modeling, and pick-sound modeling. The emulated acoustic digital tone signal is then converted to analog form for output to an amplification device.

22 Claims, 13 Drawing Sheets

U.S. PATENT DOCUMENTS

| | | | | |
|---|---|---|---|---|
| 5,051,799 | A * | 9/1991 | Paul et al. | 375/242 |
| 5,121,669 | A * | 6/1992 | Iba et al. | 84/735 |
| 5,308,916 | A | 5/1994 | Murata et al. | |
| 5,367,120 | A | 11/1994 | Hoshiai | |
| 5,541,354 | A | 7/1996 | Farrett et al. | |
| 5,731,533 | A | 3/1998 | Hoshiai | |
| 5,763,803 | A | 6/1998 | Hoshiai | |
| 5,789,689 | A | 8/1998 | Doidic et al. | |
| 5,905,222 | A | 5/1999 | Yamada | |
| 5,998,724 | A | 12/1999 | Takeuchi et al. | |
| 6,111,186 | A | 8/2000 | Krozack et al. | |
| 6,259,015 | B1 * | 7/2001 | Takahashi et al. | 84/626 |
| 6,448,488 | B1 | 9/2002 | Ekhaus et al. | |
| 6,610,917 | B2 | 8/2003 | Ludwig | |
| 6,678,209 | B1 * | 1/2004 | Peng et al. | 367/95 |
| 6,696,632 | B2 * | 2/2004 | Minakuchi et al. | 84/735 |
| 6,787,690 | B1 * | 9/2004 | Celi et al. | 84/723 |
| 7,115,810 | B2 * | 10/2006 | Ambrosino | 84/742 |
| 7,241,948 | B2 * | 7/2007 | Cummings | 84/731 |
| 2003/0000370 | A1 | 1/2003 | Kuroki | |
| 2004/0187673 | A1 * | 9/2004 | Stevenson | 84/737 |
| 2005/0039594 | A1 * | 2/2005 | Dubal | 84/737 |
| 2006/0196348 | A1 * | 9/2006 | Cummings | 84/731 |
| 2007/0191976 | A1 * | 8/2007 | Ruokangas et al. | 700/94 |

FOREIGN PATENT DOCUMENTS

| | | |
|---|---|---|
| JP | 11-224087 | 8/1999 |
| JP | 2002-041047 | 2/2002 |

OTHER PUBLICATIONS

Julius O. Smith III, Commuted Synthesis of Strings *Physical Audio Signal Processing: Digital Waveguide Modeling of Musical Instruments and Audio Effect*(2004 Draft), http://www-ccrma.stanford.edu/~jpbs/waveguide/Modeling_Acoustic_Stringed_Instruments.html.

PCT Written Opinion, mailed Oct. 12, 2005.

Japanese Patent Application No. 2004-521585, Notice of Reason for Refusal, mailed Jul. 28, 2009 (English Translation).

* cited by examiner

STRINGED INSTRUMENT WITH EMBEDDED DSP MODELING FOR MODELING ACOUSTIC STRINGED INSTRUMENTS

This application is a Continuation of application Ser. No. 10/933,653, filed Sep. 3, 2004 now U.S. Pat. No. 7,279,631 which is a Continuation-in-Part of application Ser. No. 10/197,363, filed Jul. 16, 2002 now issued as U.S. Pat. No. 6,787,690.

BACKGROUND

1. Field of the Invention

This invention relates to stringed musical instruments. In particular, the invention relates to a stringed musical instrument with embedded digital signal processing (DSP) modeling capabilities to model an acoustic stringed instrument.

2. Description of Related Art

Stringed instruments utilize vibrating strings to generate tones, and therefore music, since notes of music are merely particular tones. More particularly, a tone or note is a sound that repeats at a certain specific frequency. Throughout the world, various cultures have created a multitude of different stringed instruments such as: guitars, mandolins, banjos, basses, violins, sitars, ukuleles, etc., to create music. Moreover, with the advent of electronics, many of these stringed instruments have now been electrified to operate in conjunction with an amplifier and speaker. One of the most common stringed instruments in use today is the guitar—in both its electric and acoustic forms. The guitar is one of the most popular musical instruments in use today, and it spans a huge range of musical styles—e.g. rock, country, jazz, folk, etc.

As previously discussed, the vibrating string of a stringed instrument generates a musical tone or note, which is in turn a function of: the length of the string; the amount of tension on the string; the weight of the string; the shape and thickness of the body of the stringed instrument, etc. Generally, stringed instruments, and the guitar in particular, include a body having a bridge to which each of the strings are respectively mounted, a neck having frets and a nut or 'zero' fret, and a head having tuning pegs to which each of the strings are also respectively mounted. The length of the string is the distance between the bridge and the nut or 'zero' fret. The amount of tension on the string is determined by the winding of the tuning peg, which tightens and loosens the string (i.e. imparting tension) in order to tune the string to a certain note. In playing a stringed instrument, when a musician presses down on a string at a fret, the length of the string is changed and therefore its frequency is changed as well. The frets are spaced out so that the proper frequencies are produced when a string is held down at a given fret (and therefore the proper note is produced). However, it should be appreciated that not all stringed instruments have frets.

Looking at electrical stringed instruments, and utilizing an electric guitar as a particular example, to produce sound an electric guitar electronically senses the vibration of a string and generates an associated electrical signal and then routes the associated electric signal to an amplifier. The sensing generally occurs by utilizing electromagnetic pickups mounted under each of the strings of the guitar, respectively, in the guitars' body and neck, at different locations. These electromagnetic pickups typically consist of a bar magnet wrapped with a coil of thousands of turns of fine wire. The vibrating steel strings of the electric guitar produce a corresponding vibration in the magnetic field of the electromagnetic pickup and therefore a current in the coil. This current represents the sound of the string at the location of the pickup and can be routed to an amplifier. Many electric guitars have two or three different magnetic pickups located at different points of the body and neck. Each magnetic pickup will have a distinctive sound, and multiple pickups can be paired, either in-phase or out, to produce additional variations. Thus, the electromagnetic pickup locations for particular types of electric guitars are a major factor in determining the "sound" associated with the particular electric guitar along with other factors. For example, classic "sounds" are associated with various types of GIBSON and FENDER brand electric guitars, as well as others.

In order to achieve a diverse array of well-known or classic types of guitar tones, a guitarist has traditionally been required to use many different guitars. Previous attempts have been made to allow a guitarist to obtain many different classic guitar sounds utilizing only one guitar, however, these attempts generally require modification of the guitar, non-standard guitar cabling, and extra equipment. For example, previous attempts have been made to emulate the different sounds of various guitars by processing the individual strings of a guitar by means of a multi-phonic pickup attached to a standard electric guitar that delivers string vibration signals to a separate outboard processing unit that utilizes digital signal processing (DSP) techniques. The processing unit performs DSP algorithms on the string vibration signal to simulate the sound of a particular well-known guitar. Unfortunately, this requires modification to the standard electric guitar, the use of non-standard guitar cables, and the use of a detached processing unit away from the guitar, between the guitar and the amplification system.

Moreover, previous DSP techniques, which are utilized to emulate the locations of the electromagnetic pickups along the string for the desired electric guitar to be emulated, are inadequate. This is because these DSP algorithms only emulate the electromagnetic pickups in one-dimension, in the horizontal 'x' axis along the length of the string utilizing simplistic modeling techniques. Further, the simplistic algorithms utilized completely ignore a critical aspect of the tone produced by an electromagnetic pickup, which is its distance from the string in the vertical or 'y' axis, referred to as the "pickup height". Thus, previous modeling techniques are insufficient to truly emulate the overall tone of the guitar in response to a string vibration signal, and therefore cannot truly emulate the sound of the desired classic electric guitar, or any desired electric string instrument to be emulated for that matter.

Looking at acoustic stringed instruments, and utilizing an acoustic guitar as a particular example, presently, in order to re-create desired acoustic guitar sounds, a guitarist may use an acoustic guitar with a variety of differing microphone set-ups, transducer pickups, preamps, and signal processing equipment in order to provide very rough approximations of desired classic acoustic guitar sounds.

Further, as with electric guitars, previous attempts have been made to emulate the different sounds of various acoustic guitars by processing the individual strings of an acoustic guitar by means of a multi-phonic pickup attached to a standard acoustic guitar that delivers string vibration signals to a separate outboard processing unit that utilizes digital signal processing (DSP) techniques. The processing unit performs DSP algorithms on the string vibration signal to simulate the sound of a particular well-known acoustic guitar. Unfortunately, this requires modification to the standard acoustic guitar, the use of non-standard guitar cables, and the use of a detached processing unit away from the acoustic guitar, between the acoustic guitar and the amplification system.

More particularly, looking at sound creation fundamentals in an acoustic stringed instrument, and utilizing an acoustic guitar as a particular example, generally, an acoustic guitar produces sound by the vibration of a string of an acoustic guitar being naturally amplified acoustically by vibration-reinforcement mechanisms defined by the acoustic guitar's design and construction. Along with other factors, these vibration-reinforcement mechanisms generally include an acoustic guitar's materials, construction, size, shape, soundboard characteristics, and type of strings used. All of these constitute major factors in determining the "sound" associated with a particular acoustic guitar.

When playing an acoustic guitar in a strictly acoustic environment (with no electronics involved) the natural occurrence of the sound produces the desired result for the guitarist. However, in order to record an acoustic guitar, or to amplify an acoustic guitar for live performance, it is typically necessary to utilize an electronic means of capturing and reproducing the acoustic signal.

For recording and/or amplification, a microphone is the most commonly used device that can faithfully capture the output of an acoustic guitar, provided no other ambient noise is present and acoustic reflections from the instrument's surroundings are not sufficient as to alter the desired acoustic result.

In a live performance, the sound captured electronically needs to be amplified and played through loudspeakers for an audience to hear. One of the difficulties in a live acoustic guitar performance is producing sufficient volume without producing "feedback." If sound energy from the loudspeakers appears at the microphone with sufficient volume, then "feedback" from the signal will return to the microphone, which results in an undesirable and annoying audible sound.

Consequently, attempts have been made to capture an acoustic stringed instrument's sound with special microphones or piezoelectric devices that are acoustically coupled to the bridge or body of the acoustic stringed instrument. Although this approach allows for a higher level of amplification before feedback occurs, it fails to capture many of the important acoustic properties of the acoustic stringed instrument, such as an acoustic guitar, thus resulting in an amplified acoustic guitar sound that no longer resembles the actual acoustic guitar's sound.

BRIEF DESCRIPTION OF THE DRAWINGS

The features and advantages of the present invention will become apparent from the following description of the present invention in which.

DETAILED DESCRIPTION

In the following description, the various embodiments of the present invention will be described in detail. However, such details are included to facilitate understanding of the invention and to describe exemplary embodiments for implementing the invention. Such details should not be used to limit the invention to the particular embodiments described because other variations and embodiments are possible while staying within the scope of the invention. Furthermore, although numerous details are set forth in order to provide a thorough understanding of the present invention, it will be apparent to one skilled in the art that these specific details are not required in order to practice the present invention. In other instances details such as, well-known methods, types of data, protocols, procedures, components, processes, interfaces, electrical structures, circuits, etc. are not described in detail, or are shown in block diagram form, in order not to obscure the present invention. Furthermore, aspects of the invention will be described in particular embodiments but may be implemented in hardware, software, firmware, middleware, or a combination thereof.

Figure 1:
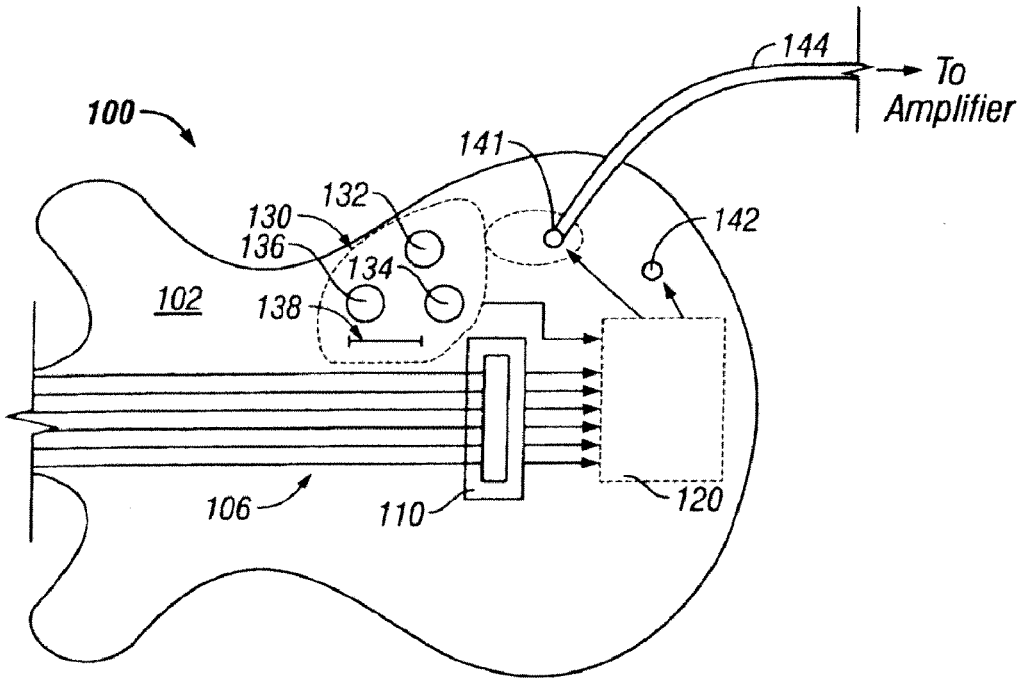
FIG. 1 is a front view of a stringed instrument with embedded digital signal processing (DSP) modeling capabilities, according to one embodiment of the present invention.

Embodiments of the invention relate to a stringed instrument with embedded digital signal processing (DSP) modeling capabilities. With reference to FIG. 1, FIG. 1 is a front view of a stringed instrument 100 with embedded digital signal processing (DSP) modeling capabilities, according to one embodiment of the present invention. The stringed instrument 100 has a body 102 and a plurality of strings 106. In this embodiment, the stringed instrument 100 has six strings and is a guitar. However, it should be appreciated that the stringed instrument 100 may be any type of stringed instrument (e.g. mandolin, banjo, bass, violin, sitar, ukulele, etc.).

Each of the plurality of strings is respectively coupled to a pickup of a polyphonic bridge pickup 110. The polyphonic bridge pickup 110 is used to detect a vibration signal for each string 106 (e.g. when a string is played by a musician). In the example shown, the polyphonic bridge 110 is a hexaphonic bridge to accommodate the six strings 106. The polyphonic bridge 110 may be a piezoelectric type of bridge to detect the vibration signal for each string or any other type of suitable sensor to detect the vibration signal for each string. The sensor also need not be integrated in the bridge assembly. A polyphonic magnetic or optical pickup that is not attached to the bridge could also be used. Moreover, in other embodiments, the polyphonic pickup may be of any suitable size to accommodate any number of strings for the desired stringed instrument to be emulated.

Also, as will be discussed, an analog to digital converter converts the detected vibration signal of a string 106 from the polyphonic bridge 100 into a digital string vibration signal, which is passed on to a digital signal processor 120 for processing. The digital signal processor 120 is located within the body 102 of the stringed instrument 100 to process the digital string vibration signal. Particularly, the digital signal processor 120 is used to process the digital string vibration signal such that the corresponding string tone of one or a plurality of selectable stringed instruments may be emulated. In one embodiment of the invention, the emulation of the corresponding string tone of the selected stringed instrument is achieved utilizing a finite impulse response (FIR) filter, as will be discussed. The emulated digital tone signal can then be converted to analog form to create an emulated analog tone signal for output to an amplification device.

Embodiments of the invention allow for desired string instrument to be selected by a user and then emulated. Particularly, a user interface 130 may be located on the body 102 of the stringed instrument 100 in order to allow a user to select one or a plurality of different types of stringed instruments that can be emulated. As will be discussed, a control processor may be coupled to the user interface to provide modeling coefficients from a memory to the digital signal processor 120 for the particular stringed instrument selected by the user to be emulated.

Further, in the guitar embodiment of the invention (i.e. where the stringed instrument 100 is a guitar), a plurality of different types of guitar are selectable by the user. For example, classic types of guitars that have associated classic "sounds" or tones that may be emulated including various types of GIBSON and FENDER brand electric guitars, various types of acoustic guitars (e.g. steel or nylon string), as well as others.

The stringed instrument 100 will hereinafter be referred to as guitar 100, in order to illustrate one embodiment of the invention and in order to simplify the explanation of the principles of the invention. However, it should be appreciated that this is only for illustrative purposes and the principles of the invention can be applied to any stringed instrument (e.g. mandolin, banjo, bass, violin, sitar, ukulele, etc.).

One advantage of the invention is that because the digital signal processor 120 is contained within the guitar 100, extra equipment such as detached processing units for DSP processing in between the guitar and the amplifier are not necessary. The guitar 100 with embedded DSP modeling capabilities also has a first output jack 141 and an optional second output jack 142 for output of the emulated analog vibration signal. Further, a standard cable 144 can be used to route the emulated analog vibration signal (i.e. the sound) of the emulated guitar to an amplification system such as an amplifier. Thus, embodiments of the invention provide a much simpler and more accurate solution to emulating stringed instruments, such as guitars, than in the past.

Returning again to the user interface 130 of the guitar 100, in one embodiment, the user interface 130 is located on the body of the guitar and includes a volume knob 132 to adjust the volume of the guitar 100, a tone knob 134 to adjust the tone of the guitar 100, and a guitar selector knob 136 to select the type of guitar to be emulated. For example, the guitar selector knob 136 can be moved to a plurality of different positions to choose a plurality of different types of guitars to be emulated. As one example, the guitar selector knob can be moved to a plurality of different positions to select a variety of different types of GIBSON brand electric guitars, a variety of different types of FENDER brand electric guitars, a variety of different types of acoustic guitars (steel or nylon string), as well as other types of guitars or even other types of stringed instruments.

Moreover, the user interface 130 includes a blade switch, which can be utilized as an emulated pickup selector to select emulated pickups (e.g. rhythm, treble, standard, etc.) for the selected emulated guitar chosen by the guitar selector knob 136. Furthermore, the blade switch 138 can be utilized in conjunction with the guitar selector knob 136 to generate a wide variety of different emulated guitar tones such as by providing further emulated pickup configurations, different wiring, or just entirely different types of emulated guitar or other stringed instrument tones. It should be appreciated that although a particular user interface 130 has been described with reference to FIG. 1, a wide variety of different types of user interfaces including LCDs, graphic displays, touchscreens, alphanumeric entry keys, etc., can be used to perform the functions of the guitar selector knob, the blade switch, the tone knob, and the volume knob and other functions associated with embodiments of the invention.

Figure 2:
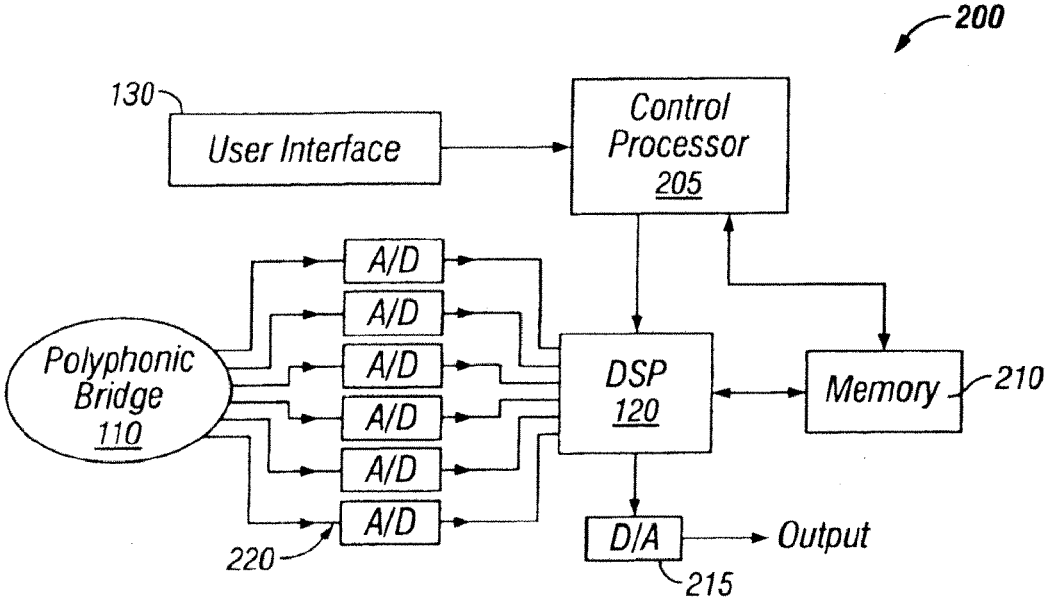
FIG. 2 is a block diagram illustrating the functional blocks of the stringed instrument with embedded digital signal processing (DSP) modeling capabilities, according to one embodiment of the present invention.

Turning now to FIG. 2, FIG. 2 is a block diagram illustrating the functional blocks 200 of a stringed instrument with embedded digital signal processing (DSP) modeling capabilities, e.g. guitar 100, according to one embodiment of the present invention. As shown in FIG. 2, the functional blocks 200 include the user interface 130 (previously discussed), a control processor 205, digital signal processor 120, memory 210, digital to analog (D/A) converter 215, and a plurality of analog to digital (A/D) converters 220. The polyphonic pickup 110 is coupled to the plurality of A/D converters 220 and the A/D converters 220 are each respectively coupled to digital signal processor 120. In this example, there are six A/D converters, one for each string of the guitar. As previously discussed, the polyphonic pickup 110 is used to detect a vibration signal for each string (e.g. when a string is played by a musician). The detected vibration signal for the signal for the string is then coupled to a respective A/D converter 220. The respective A/D converter 220 converts the detected vibration signal of the string into a digital string vibration signal and couples the digital string vibration signal to the digital signal processor 120.

The digital signal processor 120 then processes the digital string vibration signal. As previously discussed, the user interface 130 allows a user to select one or a plurality of different types of guitars that can be emulated. Particularly, the digital signal processor 120 is used to process the digital string vibration signal such that the corresponding string of the selected guitar is properly emulated based on modeling coefficients for the selected guitar stored in memory 210. The user interface 130 is coupled to the digital signal processor 120 by the control processor 205. Also, memory 210 can be directly coupled to digital signal processor 120.

The control processor 205 provides the proper modeling coefficients from memory 210 to the digital signal processor 120 for the particular guitar selected by the user. In this way, the digital signal processor 120 performs the proper transformations on the digital string vibration signal to properly emulate the corresponding string tone of the particular guitar chosen by the user as it is played. Although the control processor 205 is shown as a separate circuit, it should be appreciated that the functionality of the control processor can instead be performed by the digital signal processor 120, in other embodiments. As will be discussed, in one embodiment of the invention, one aspect of the emulation of the corresponding string of the selected guitar is achieved utilizing a finite impulse response (FIR) filter. The emulated digital tone signal is then converted to analog form by D/A converter 215 to create an emulated analog tone signal for output to an amplification device. For example, the emulated analog vibration signal can be transmitted from the guitar 100 to an amplifier (not shown) utilizing a standard guitar cable.

The control processor 205 may be any sort of suitable processor or microprocessor to process information in order to implement the functions of the embodiments of the invention. As illustrative examples, the "processor" may include a processor having any type of architecture such as complex instruction set computers (CISC), reduced instruction set computers (RISC), very long instruction word (VLIW), or hybrid architecture, a microcontroller, a state machine, etc. Further, the digital signal processor 120 may be any suitable general DSP processing chip in order to implement the digital signal processing functions of the embodiments of the invention, as will be discussed. Examples of suitable DSP processing chips include chips produced by MOTOROLA, SHARP, TEXAS INSTRUMENTS, etc.

The memory 210 may include various types of flash programmable memory, non-volatile memory, and volatile memory, etc. Memory 210 is capable of storing data as well as instructions to be executed by processor 205 and may be used to store temporary variables (e.g. audio data, calculated parameters, etc.) or other intermediate information during execution of instructions by control processor 205 and digital signal processor 120. Non-volatile memory may be used for storing static information (e.g. particular FIR filters, modeling coefficients, other parameters, etc.) and instructions for control processor 205 and digital signal processor 120. Examples of non-volatile memory include ROM type memories and/or other static storage devices such as hard disk, flash memory, battery-backed random access memory, and the like, whereas volatile main memory 222 includes random access memory (RAM), dynamic random access memory (DRAM) or static random access memory (SRAM), and the like.

In continuing with this example, the control processor 205 and digital signal processor 120 may operate under the control of software or firmware modules that are booted into memory for execution when the guitar 100 is powered-on or reset. These software or firmware modules typically include programs that allow for the selection of a desired guitar to be emulated by the user and further control the selection and implementation of the correct modeling coefficients for digital signal processing on input digital vibration signals (e.g. to implement FIR filters) such that the desired guitar sounds are properly emulated, and other DSP functions related to embodiments of the invention, as will be discussed.

These functions can be implemented as one or more instructions (e.g. code segments), to perform the desired functions or operations of the invention. When implemented in software (e.g. by a software or firmware module), the elements of the present invention are the instructions/code segments to perform the necessary tasks. The instructions which when read and executed by a machine or processor (e.g. processor 205), cause the machine or processor to perform the operations necessary to implement and/or use embodiments of the invention. The instructions or code segments can be stored in a machine readable medium (e.g. a processor readable medium or a computer program product), or transmitted by a computer data signal embodied in a carrier wave, or a signal modulated by a carrier, over a transmission medium or communication link. The machine-readable medium may include any medium that can store or transfer information in a form readable and executable by a machine (e.g. a processor, a computer, etc.). Examples of the machine readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via networks such as the Internet, Intranet, etc.

Moreover, the emulated digital tone signal may undergo further digital signal processing to emulate one or a plurality of amplifier and speaker cabinet setups before being converted to an analog vibration signal and transmitted to a real amplifier. Existing software modules can be utilized to digitally process the emulated digital tone signal for the selected guitar such that it is processed to sound as if it is being played through one or a plurality of different amplifier and cabinet setups. Examples of common amplifier and cabinet setups are those produced by MARSHALL, FENDER, VOX, ROLAND, etc.

In particular, it should be appreciated that DSP algorithms for digitally processing the emulated digital tone signal for the selected guitar such that it is processed to sound as if it is being played through one or a plurality of different amplifier and cabinet setups are known in the art and can be easily implemented by an appropriate software module in conjunction with control processor 205 and digital signal processor 120. One example of DSP algorithms for altering the digital guitar signals to model various amplifiers and speaker cabinet configurations which may be used is particularly described in U.S. Pat. No. 5,789,689 entitled "Tube Modeling Programmable Digital Guitar Amplification System", which is hereby incorporated by reference. Moreover, other software modules used in LINE6 products such as in AMP FARM and POD products may also be utilized.

Figure 3:
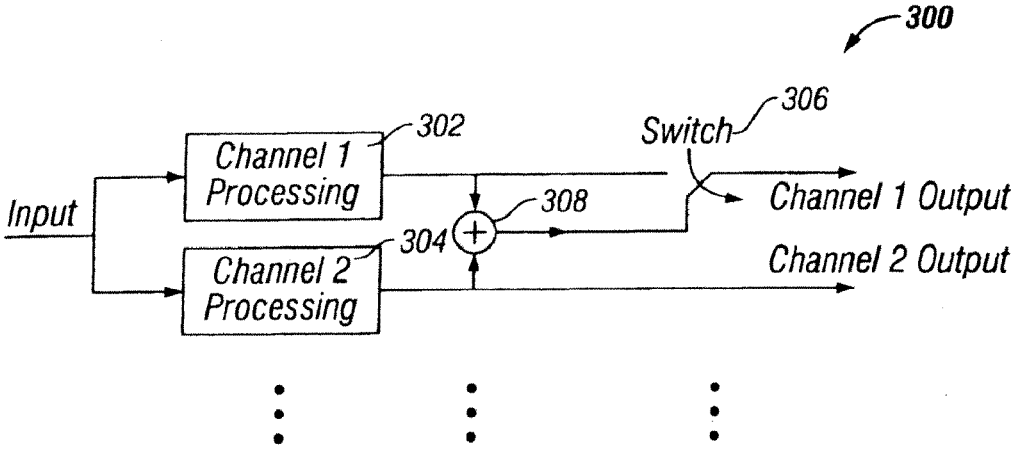
FIG. 3 is a block diagram illustrating multiple emulated stringed instruments being combined such that they can be played simultaneously, according to one embodiment of the present invention.

With reference now to FIG. 3, FIG. 3 is a block diagram 300 illustrating multiple emulated stringed instruments, e.g. guitars, being combined such that they are played simultaneously, according to one embodiment of the present invention. Particularly, as shown in FIG. 3, an input vibration signal of the string detected by the polyphonic bridge is inputted into a plurality of processing channels, where each channel processes a different emulated stringed instrument. This simultaneous processing can be achieved by one DSP (instance 120 of FIG. 2) which performs parallel processing of the input to emulate different stringed instruments, or alternatively inputted into a plurality of DSP instances processing a different type of emulated stringed instrument (e.g. different types of guitars) for a given digital string input vibration signal (i.e. from the played string).

As previously discussed, in the guitar embodiment, typically only one type of guitar for a given digital string input vibration signal is emulated at a time. However, embodiments of the invention provide for multiple guitars being emulated simultaneously for the given played string vibration signal to give a much more diverse range of sounds. In this embodiment, a switch 306 can be activated such that the emulated guitar signals are combined by adder 308 and outputted along channel 1 output. Then the combined emulated guitar signals can be converted to analog form and outputted for amplification, as previously discussed. On the other hand, when switch 306 is not activated the channels are kept separated for output to independent channels. It should be appreciated that any number of channel processing units, adders, and switches can be used to combine a multitude of different emulated stringed instrument and guitar sounds together, simultaneously, to create a much more diverse range of sound. Further, the user interface 130 may allow a user to select a multitude of different guitars and other types of stringed instruments to be selected and played simultaneously.

Details of some of the DSP algorithms for a stringed instrument (e.g. guitar) with embedded digital signal processing (DSP) modeling capabilities of the present invention will now be discussed. Particularly, finite impulse response (FIR) filters, system block diagrams, and other charts will be discussed to show how some aspects of the string tone of an electric stringed instrument, such as a guitar 100, is properly modeled in order to provide a stringed instrument that can properly emulate a plurality of different types of electric stringed instruments. As previously discussed, the invention is also capable of emulated acoustic stringed instruments. The following discussion will refer to a guitar string for guitar, however, as previously discussed the DSP modeling can apply to any string of any stringed instrument. In one embodiment of the invention, the emulation of one aspect of the corresponding string tone of the selected guitar is achieved utilizing a finite impulse response (FIR) filter, as will be discussed. Moreover, embodiments of the invention further provide for emulating the pickup height of an electromagnetic pickup (e.g. along the vertical or 'y' axis) for the corresponding string of the emulated guitar, as well as emulating the guitar string's response along the x-axis. In this way, the overall tone of the guitar in response to a string vibration signal detected by an electromagnetic pickup at a particular location relative to the string is emulated along both the 'x' and 'y' axis, and thus the sound of a desired guitar can be truly emulated. However, it should be appreciated that the 'x' and 'y' axis calculations can be determined for any type of electrified string instrument in order to more accurately emulate the stringed instrument.

Figure 4:
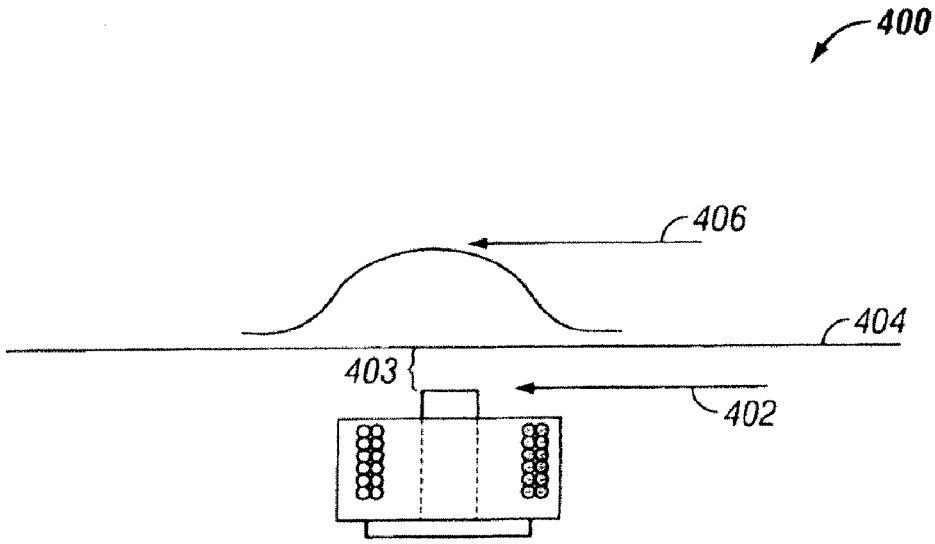
FIG. 4 shows an electromagnetic pickup located relatively distant (i.e. having a relatively large pickup height) from a guitar string and the resulting magnetic aperture.
Figure 5:
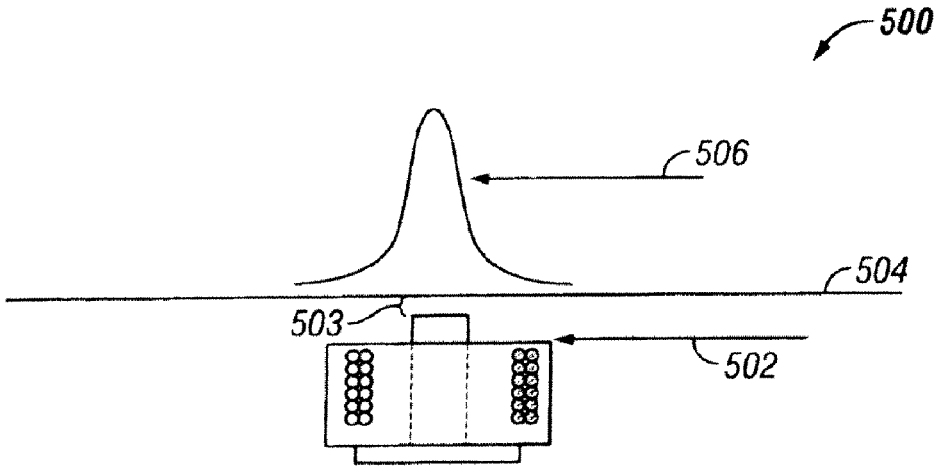
FIG. 5 shows an electromagnetic pickup located relatively close (i.e. having a relatively small pickup height) from a guitar string and the resulting magnetic aperture.

But first, a discussion will be provided to discuss how the pickup height of an electromagnetic pickup of an electric guitar affects the shape of the magnetic aperture of the string, which directly affects the tone of the string of the guitar. Turning now to FIG. 4, FIG. 4 shows an electromagnetic pickup 402 (e.g. located in the body or neck of a guitar) located relatively distant (i.e. having a relatively large pickup height 403) from a guitar string 404 and the resulting magnetic aperture 406. The strength of the magnetic field along the length of the string, is known as the "magnetic aperture" or "sensing window" of the electromagnetic pickup. The magnetic aperture is directly dependent on the pickup height 403. As depicted in FIG. 4, when the electromagnetic pickup 402 is relatively distant from the guitar string the shape of the magnetic aperture 406 is broad with a lower amplitude. On the other hand, looking to FIG. 5, FIG. 5 shows an electromagnetic pickup 502 located relatively close (i.e. having a relatively small pickup height 503) from a guitar string 504 and the resulting magnetic aperture 506. As shown in FIG. 5, a relatively small pickup height 503 results in a magnetic aperture 506 that is narrower with a higher amplitude. Also, depending on the pickup configuration, the magnetic aperture need not be symmetrical.

The second way that the pickup height affects the tone of a guitar string of a guitar is in the degree of non-linearity of the output signal in response to a string vibration signal. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that a nonlinear gain needs to be applied to model the non-linear distortion associated with the pickup height of the electromagnetic pickup and to therefore properly model or emulate the true sound of the guitar string. Of course, depending on the pickup height, the amount of non-linearity will vary. This will be discussed in more detail later.

Discussion will now proceed as to how a guitar string of a particular guitar with a certain configuration of electromagnetic pickups is modeled to generate an appropriate digital system characterization for implementation by digital signal processing (DSP), and particularly by the stringed instrument (e.g. guitar) with embedded digital signal processing (DSP) modeling capabilities according to embodiments of the present invention. Particularly, modeling coefficients for finite impulse response (FIR) filters can be determined by the process to be described hereinafter for a plurality of different guitars and other stringed instruments such that plurality of different guitars and other stringed instruments can be digitally emulated and offered as choices to a user.

Figure 6:
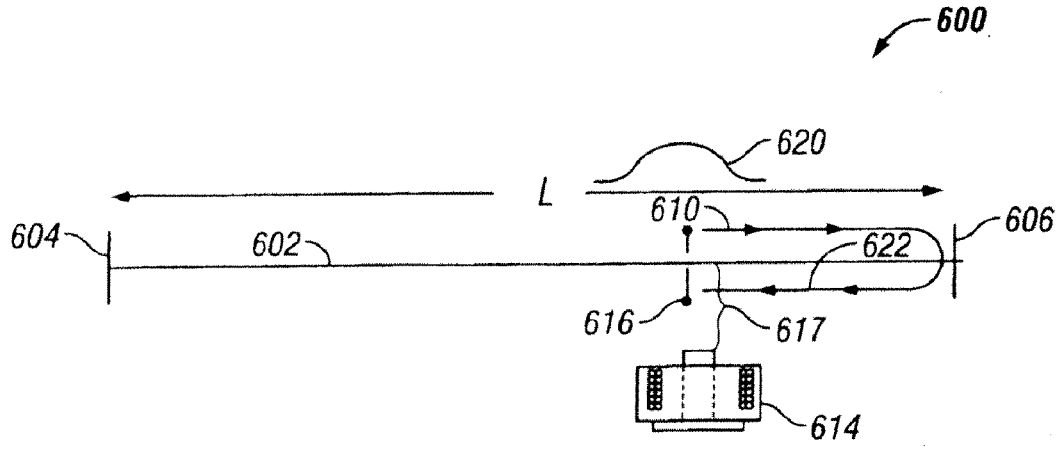
FIG. 6 shows a diagram illustrating a process for digitally modeling a magnetic aperture of a guitar string of a particular guitar having an electromagnetic pickup at a particular location, according to one embodiment of the present invention.

Turning now to FIG. 6, FIG. 6 shows a diagram illustrating a process 600 for digitally modeling a magnetic aperture of a guitar string of a particular guitar with an electromagnetic pickup at a particular location. As shown in FIG. 6, a guitar string 602 is coupled between a tuning nut 604 and a bridge 606 and has a length L. An initial impulse wave 610 travels along the guitar string 602 with an electromagnetic pickup 614 underneath the string at a distance x 616 from the bridge 606. Further, the electromagnetic pickup 614 has a corresponding pickup height y 617. The shape of the magnetic aperture 620 becomes the shape of the electromagnetic pickup output in response to the initial impulse wave 610. When the initial impulse wave 610 reaches the bridge 606, the impulse wave is inverted becoming the reflected impulse wave 622 and travels back along the guitar string 602 in the opposite direction, with a corresponding response that is inverted and mirrored from the response in the forward direction. Thus, a total impulse response can be calculated to be a summation of the initial impulse wave 610 and the reflected impulse wave 622 responses.

The time delay between these two responses is the time it takes the initial impulse wave 610 to travel a distance of 2*x. This can be calculated as:

$$\tau = \frac{x}{L \cdot f_0}$$

where $f_0$ is the guitar string's open frequency.

In a sampled or digital system, this time delay is achieved by a delay of N samples such that:

$$N = \frac{x \cdot f_s}{L \cdot f_0}$$

where fs is the time sampling frequency of the system.

Figure 7:
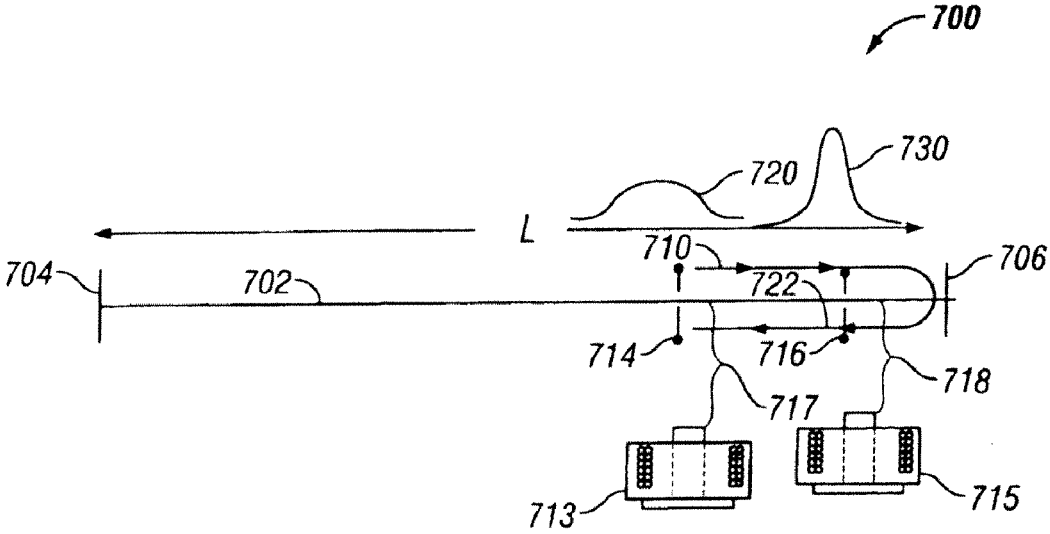
FIG. 7 shows a diagram illustrating process for the digitally modeling magnetic apertures for a guitar string of a particular guitar with a first electromagnetic pickup at a first location and a second electromagnetic pickup at a second location, according to one embodiment of the present invention.

Turning now to FIG. 7, FIG. 7 shows a diagram illustrating a process 700 for digitally modeling magnetic apertures for a guitar string of a particular guitar with a first electromagnetic pickup at a first location and a second electromagnetic pickup at a second location. As shown in FIG. 7, a guitar string 702 is coupled between a tuning nut 704 and a bridge 706 and has a length L. An initial impulse wave 710 travels along the guitar string 702 with a first electromagnetic pickup 713 underneath the string at a distance x1 714 from the bridge 706 and a second electromagnetic pickup 715 underneath the string at a distance x2 716 from the bridge 706. Further, the first electromagnetic pickup 713 has a corresponding pickup height y1 717 and the second electromagnetic pickup 715 has a corresponding pickup height y2 718.

The shape of the first magnetic aperture 720 becomes the shape of the output of the first electromagnetic pickup 713 in response to the initial impulse wave 710. Again, when the initial impulse wave 710 reaches the bridge 706, the impulse wave is inverted becoming the reflected impulse wave 722 and travels back along the guitar string 702 in the opposite direction, with a corresponding response that is inverted and mirrored from the response in the forward direction. Thus, a total impulse response for the first magnetic aperture 720 for the first electromagnetic pickup 713 can be calculated to be a summation of the initial impulse wave 710 and the reflected impulse wave 722 responses for the first electromagnetic pickup 713.

Similarly, the shape of the second magnetic aperture 730 becomes the shape of the output of the second electromagnetic pickup 715 in response to the initial impulse wave 710. Again, when the initial impulse wave 710 reaches the bridge 706, the impulse wave is inverted becoming the reflected impulse wave 722 and travels back along the guitar string 702 in the opposite direction, with a corresponding response that is inverted and mirrored from the response in the forward direction. Thus, a total impulse response for the second magnetic aperture 730 for the second electromagnetic pickup 715 can be calculated to be a summation of the initial impulse wave 710 and the reflected impulse wave 722 responses for the second electromagnetic pickup 715.

Further, in the case of multiple electromagnetic pickups 713 and 715 sensing the string vibration signal, N (the delay) is computed in the same way for each electromagnetic pickup. Also, it should be noted that the response of the second electromagnetic pickup 715 is closer to the bridge and is therefore delayed relative to response of the first electromagnetic pickup 713 farthest from the bridge. The delay D between the responses is calculated based on the same principles of wave velocity and distance and leads to the general solution for n electromagnetic pickups:

$$N_n = \frac{X_n \cdot f_s}{L \cdot f_0};\ D_n = \frac{(N_l - N_n)}{2};\ n = 1, 2, 3\ldots$$

The magnetic apertures 720 and 730 can be represented as finite impulse response (FIR) filters, respectively, whose coefficients are the measured field strength along the string, sampled at a distance interval, d, determined by the wave velocity $f_0$, the time-sampling frequency $f_s$, and the length of the string, L.

$$d = 2 \cdot L \cdot f_0 / f_s$$

As is known in the art, FIR filters have the mathematical form $y_n = h_0x_0 + h_1x_1 + h_2x_2 + \ldots h_Nx_N$; where $h_n$ are fixed filter coefficients from 0 to N, and $x_0$ to $x_N$ are the data samples (in this case the sampled digital string vibration signals from the polyphonic bridge). By performing the above process 700 to calculate the impulse responses for the electromagnetic pickups 713 and 715 all of the fixed $h_n$ modeling coefficients can be calculated and a digital transfer function can be calculated for the guitar string of the desired guitar to be emulated. The coefficients for each string of each selectable guitar or other stringed instrument can be stored in the memory 210 of the guitar with embedded DSP modeling capabilities 100. Also, it should be appreciated that when the inverted impulse travels back along the string, the modeling coefficients are mirrored about the center. Thus, the same coefficients can be read in reverse order, eliminating the need for extra storage space for the inverted impulse filter. Accordingly, tables of modeling coefficients that represent the magnetic aperture for various configurations of electromagnetic pickups having various pickup heights (y-axis) can be stored in memory to effectively emulate each string of a multitude of different types of guitars (e.g. electric, acoustic, etc.), as well as other stringed instruments for selection by a user.

Figure 8:
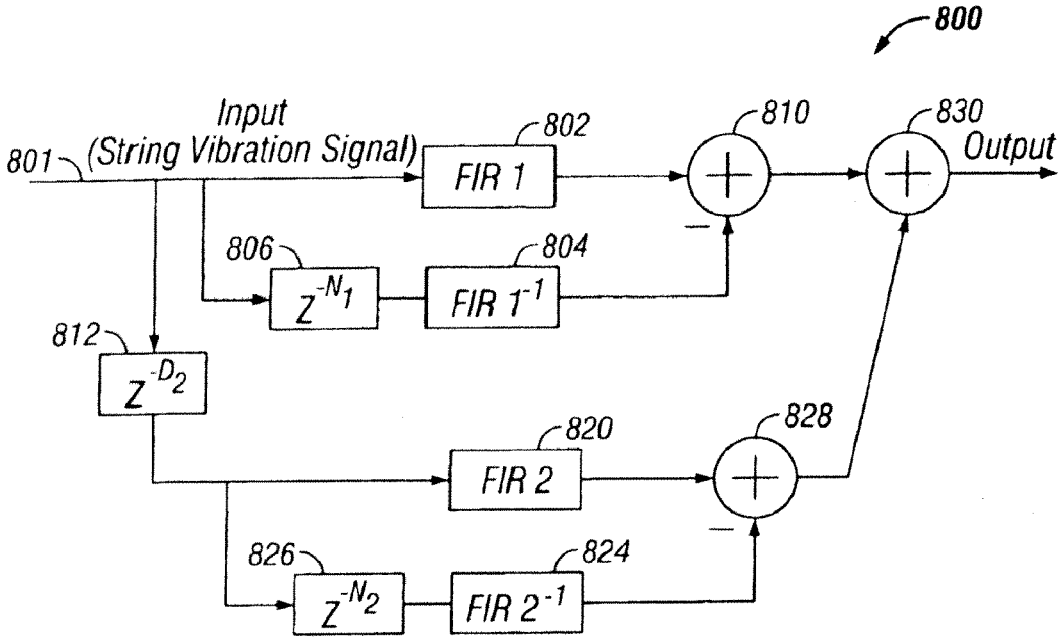
FIG. 8 shows an example of a block diagram of a generalized DSP algorithm for emulating the guitar that was previously modeled having two electromagnetic pickups located at particular x (horizontal) locations and at particular y (pickup height) displacements along the string of the guitar (FIG. 7), wherein the resulting magnetic apertures are emulated with FIR filters, according to one embodiment of the present invention.

With reference now to FIG. 8, FIG. 8 shows an example of a block diagram of a generalized DSP algorithm 800 for emulating the guitar that was previously modeled having two electromagnetic pickups 713 and 715 located at particular x (horizontal) locations and at particular y (pickup height) displacements along the string 702 of the guitar (FIG. 7), wherein the resulting magnetic apertures 720 and 730 are emulated with FIR filters. As shown in FIG. 8, an input digital string vibration signal 801 for the string enters the DSP block diagram 800. It should be appreciated that the generalized DSP block diagram is a representation of the digital transfer function for the emulation of the previously modeled guitar string 702 of the desired guitar to be emulated having the particular configuration of electromagnetic pickups 713 and 715, as previously discussed. However, it should be appreciated that this generalized DSP block can be applied to any string of any guitar having two electromagnetic pickups, or any other stringed instrument as the equations will remain the same and different values for the variables for the particular guitar or stringed instrument to be modeled can be used.

By way of illustration, the input digital string vibration signal 801 is processed by FIR1 802 emulating the magnetic aperture filter response for electromagnetic pickup 713 in response to the initial vibration signal and by FIR$\mathbf{1}^{-1}$ 804 which is the inverse of FIR1 representing the magnetic aperture filter response for electromagnetic pickup 713 in response to the reflected vibration signal (i.e. reflected from the bridge). Further, the input digital vibration signal 801 is delayed by $z^{-N}{}_1$ such that the reflected vibration signal is emulated as being delayed by $N_1$ samples. Also, as is known in digital system theory $z^{-N}$ represents the sampled digitized equivalent of the true input vibration signal 801 delayed by N samples. Moreover, the initial and reflected magnetic aperture FIR responses of FIR1 802 and FIR$\mathbf{1}^{-1}$ 804 to the input vibration signal 801 are then summed with adder 810 to generate an emulated digital string tone signal of emulated electromagnetic pickup 713.

Similarly, after the input vibration signal 801 is delayed by $z^{-D}{}_2$ 812 such that the response of the second electromagnetic pickup 715, which is closer to the bridge, is properly delayed relative to the response of the first electromagnetic pickup 713 farthest from the bridge, the input digital string vibration signal 801 is processed by FIR2 820 emulating the magnetic aperture filter response for electromagnetic pickup 715 in response to the initial vibration signal and by FIR$\mathbf{2}^{-1}$ 824 which is the inverse of FIR2 representing the magnetic aperture filter response for electromagnetic pickup 715 in response to the reflected vibration signal (i.e. reflected from the bridge). Further, the delayed input vibration signal from the output of delay 812 is delayed by $z^{-N}{}_2$ 826 such that the reflected vibration signal is emulated as being delayed by $N_2$ samples. Moreover, the initial and reflected magnetic aperture FIR responses of FIR2 820 and FIR$\mathbf{2}^{-1}$ 824 to the input vibration signal 801 are then summed with adder 826 to generate an emulated digital string vibration signal of emulated electromagnetic pickup 715.

Lastly, both the emulated digital string tone signal of emulated electromagnetic pickup 713 and emulated digital string tone signal of emulated electromagnetic pickup 715 are summed by adder 830 such that an emulated digital tone signal for the corresponding string of the desired guitar that the user has chosen to be emulated (which as in this example has the particular configuration of electromagnetic pickups 713 and 715) is created. This emulated digital tone signal can then be further processed by additional tone-shaping blocks or converted to analog format and outputted to an amplifier which can then playback the emulated tone such that the guitar with embedded DSP modeling capabilities 100 sound like the desired guitar chosen by the user.

Thus, a digital transfer function represented by generalized DSP block diagram 800 incorporating predetermined FIR filters having predetermined modeling coefficients, based on impulse responses of the modeled electromagnetic pickups, and calculated delays, is created. This digital transfer function can be used emulate the output signal of a guitar string for the particular guitar chosen by a user (having a given configuration of electromagnetic pickups previously modeled) in response to a digital input signal from a played string. In other words, based on a digital string vibration signal detected by the pickup, the digital signal processor 120 implementing the particular digital transfer function (with predetermined modeling coefficients) of the generalized DSP block diagram 800 can process the digital string vibration signal to emulate the corresponding string tone of a previously modeled guitar (which has a particular configuration of electromagnetic pickups (e.g. in this case two pickups)) to create an emulated digital tone signal for the played string. This emulated digital tone signal can then be converted to analog format and outputted to an amplifier which can then playback the emulated tone such that the guitar with embedded DSP modeling capabilities 100 sounds like the guitar selected by the user. It should be appreciated by those skilled in the art that the above-described DSP algorithms model pickup locations in two dimensions and that further processing is generally required to ultimately generate an output signal.

Although the previously described generalized DSP block diagram 800 shows one example of a DSP block diagram for a guitar having two electromagnetic pickups for a particular guitar string, it should be appreciated by those skilled in the art that the previously described processes and methods of characterizing the guitar string of the guitar with a particular configuration of electromagnetic pickups can be done for any guitar string of any guitar having any number of electromagnetic pickup configurations and any number of strings. Thus, any guitar, or any stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings. Accordingly, a digital transfer function and corresponding DSP block diagram model can be created and used to emulate an output signal for any guitar or stringed instrument in response to a digital input signal from a played string. In other words, based on a digital string vibration signal detected by the bridge, the digital signal processor 120 implementing a particular digital transfer function (with predetermined modeling coefficients) can process the digital string vibration signal to emulate a corresponding string's tone of a desired guitar that the user has chosen to be emulated to create an emulated digital tone signal of the selected guitar. This emulated digital tone signal can then be converted to analog format and outputted to an amplifier which can then playback the emulated tone such that the guitar with embedded DSP modeling capabilities sounds like the desired guitar chosen by the user. Moreover, this methodology can be applied to any stringed instrument, e.g., acoustic guitars, mandolins, basses, etc.

Also, important to accurately modeling the tone of a guitar is the way the pickup height affects the tone of the guitar by introducing non-linear distortion into the output signal of the guitar in response to the string vibrating. The magnetic field strength in the vertical axis or 'y' axis is strongest right above the electromagnetic pickup, and it is weaker as the vertical distance increases. Therefore, when a string is played, the string's oscillation brings the string closer to and farther from the electromagnetic pickup such that non-linear distortion is introduced into the guitar output and therefore a nonlinear gain needs to be applied to properly model or emulate the true sound of the guitar string. Of course, depending on the pickup height, the amount of non-linearity will vary.

Embodiments of the invention further provide for emulating the pickup height of an electromagnetic pickup (e.g. along the vertical or 'y' for the axis) for the corresponding string of the emulated guitar. More particularly, emulating the pickup height of the electromagnetic pickup also includes applying a non-linear gain to model non-linear distortion associated with the pickup height of the electromagnetic pickup for the corresponding string of the emulated stringed instrument, e.g. a guitar, in the processing of the digital string vibration signal. In this way, the overall tone of the guitar in response to a string vibration signal is emulated along both the 'x' and 'y' axis, and thus the sound of a selected guitar to be emulated, can be more truly emulated.

Figure 9:
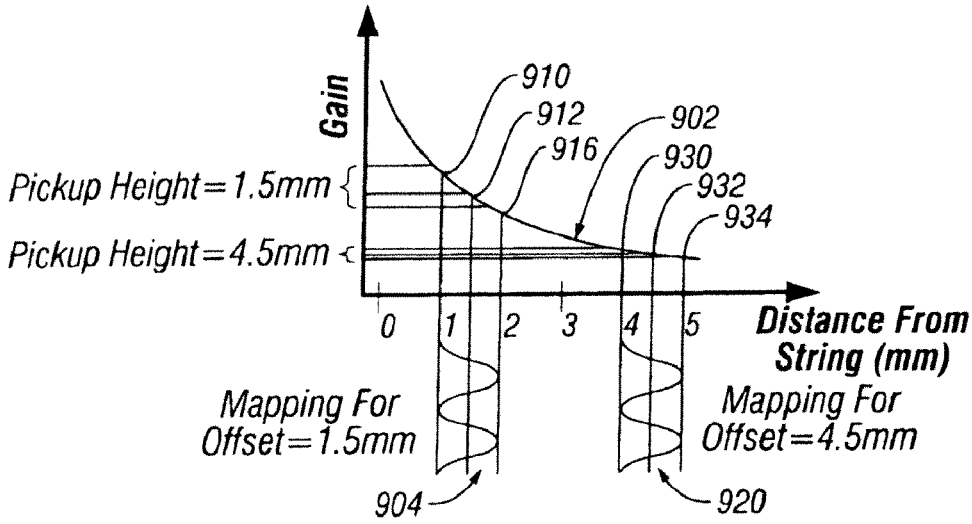
FIG. 9 shows a non-linear gain curve for different pickup heights in relation to a vibrating string, according to one embodiment of the present invention.

In order to model the non-linearity of a vibrating string with respect to differing pickup heights of an electromagnetic pickup, a string vibration signal that represents the distance traveled by a string to or from an electromagnetic pickup (along the y axis), from the at rest 'bias' point of the string, can be used with reference to a non-linear gain curve. Referring now to FIG. 9, FIG. 9 shows a non-linear gain curve 902 for different pickup heights in relation to a vibrating string. Particularly, a string vibration signal is mapped to the non-linear gain curve 902, where the maximum attainable amplitude of the string vibration signal corresponds to the maximum amount of string travel from observation. As will be discussed, an offset can then be added to the digital string vibration signal to obtain the proper gain and hence simulate the effect of the pickup height and the degree of non-linearity that is introduced due to the pickup height in relation to the vibrating string.

Figure 10A:
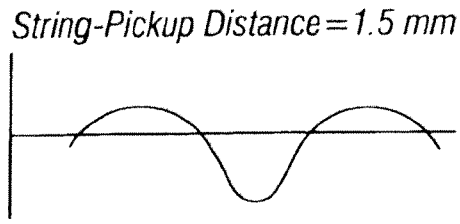
FIG. 10*a* shows an example of the distorted output of a vibrating string (e.g. output in voltage) due to non-linear gain for a first relatively close pickup height.

FIG. 9 demonstrates this effect for a sinusoidally vibrating string vibrating with an amplitude of 1 millimeter (mm) peak-to-peak over the region of a virtual electromagnetic pickup (i.e. over the pickup height, the bias point, when the string is at rest). The variable gain is shown at min, max, and mid string vibration for these two locations. As a first example, a sinusoidally vibrating string 904 is shown vibrating about a virtual electromagnetic pickup, wherein the pickup height is 1.5 mm (i.e. this is the bias point when the string is at rest) and the string vibrates between a 1 mm pickup height and a 2 mm pickup height. Correspondingly on the non-linear gain curve 902 an associated gain at a minimum 910 (i.e. pickup height=1 mm) can be found, an associated gain at middle 912 (i.e. pickup height=1.5 mm, the bias point), and an associated gain at maximum 916 (i.e. pickup height=2 mm). FIG. 10*a* shows an example of the distorted output of vibrating string 904 (e.g. output in voltage) due to non-linear gain.

Figure 10B:
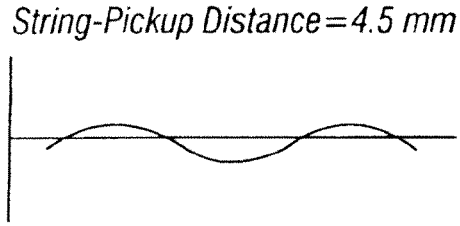
FIG. 10*b* shows the distorted output of a vibrating string (e.g. output in voltage) due to non-linear gain for a second relatively distant pickup height.

As a second example, a sinusoidally vibrating string 920 is shown vibrating about a virtual electromagnetic pickup, wherein the pickup height is 4.5 mm (i.e. this is the bias point when the string is at rest) and the string vibrates between a 4 mm pickup height and a 5 mm pickup height. Correspondingly on the non-linear gain curve 902 an associated gain at a minimum 930 (i.e. pickup height=4 mm) can be found, an associated gain at middle 932 (i.e. pickup height=4.5 mm, the bias point), and an associated gain at maximum 934 (i.e. pickup height=5 mm). FIG. 10*b* shows the distorted voltage output of vibrating string 920 (e.g. output in voltage) due to non-linear gain.

As can be seen in FIGS. 10*a* and 10*b*, the output of the same vibrating string signal gets more heavily distorted as the pickup gets closer to the string. Thus, in FIG. 10*a* where the pickup is relatively close (i.e. pickup height=1.5 mm) the output signal is more heavily distorted than in FIG. 10*b* where the pickup is relatively farther away (i.e. pickup height=4.5 mm). This can be modeled as shown in FIG. 9 by a non-linear gain curve that provides a relatively high variation in gain for a pickup height of 1.5 mm, as compared to the more consistent gain for a pickup height at 4.5 mm. Accordingly, the non-linear gain curve 902 can be used provide offsets or gain for differing pickup heights (e.g. 1.5 mm and 4.5 mm) to simulate the non-linearity of the pickup response for an electromagnetic pickup having pickup heights at these distances.

This non-linear distortion effect for a given electromagnetic pickup at given pickup heights can be compensated for by utilizing, for example, a lookup table that describes the non-linear gain of the pickup as previously characterized with a non-linear gain curve 902 as shown in FIG. 9. Moreover, multiple lookup tables can hold non-linear gain curves for each of a wide variety of different electromagnetic pickups that are to be emulated.

Figure 11:
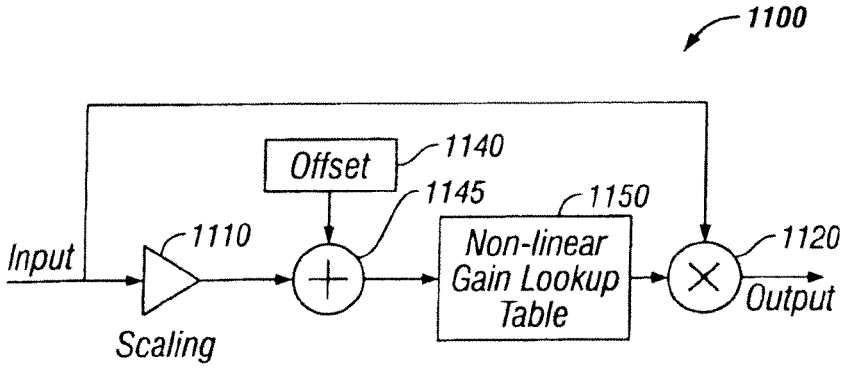
FIG. 11 shows a block diagram of a DSP algorithm that can be utilized for implementing non-linear gain modeling of a string in relation to an electromagnetic pickup at given pickup heights, according to one embodiment of the present invention.

Looking now to FIG. 11, FIG. 11 shows a block diagram of a DSP algorithm 1100 that can be utilized for implementing the non-linear gain modeling of a string in relation to an electromagnetic pickup at given pickup heights, as previously discussed. First, an input digital string vibration signal is scaled by scaling block 1110. The input digital string vibration signal is also directly routed to multiplier block 1120. Particularly, the value of the input digital string vibration signal (e.g. a digital representation of a voltage) is converted to a scaled physical vibration distance amplitude. The vibrating strings 904 and 920 have been scaled to an amplitude of 1 mm.

An offset from offset block 1140 is added by adder block 1145 to simulate the distance from the pickup height being modeled. This offset is added to the scaled physical vibration distance amplitude and provides the input to the non-linear gain lookup table 1150 to find a resultant non-linear gain that should be applied to properly emulate the non-linear distortion of the tone of the string in relation to the height of the particular electromagnetic pickup being modeled. The gain value is multiplied at multiplier block 1120 with the original input digital signal to obtain the emulated digital tone signal being emulated as if it were actually distorted by the real non-linear gain effect of the particular electromagnetic pickup at the specific pickup height.

For example, if the input digital vibration signal of string 904 is scaled to an amplitude of 1 mm and has a scaled vibration distance amplitude reading of 0.3 mm and the pickup height or offset is 1.5 mm, a resultant gain would be found in the non-linear gain lookup table 1150 for a corresponding non-linear gain value for the particular electromagnetic pickup being modeled by getting the value of the gain that corresponds to 1.8 mm (1.5 mm+0.3 mm). The gain value will be multiplied at multiplier block 1120 with the original digital input signal to obtain the emulated digital tone signal, which is emulated as if it were actually distorted by the real non-linear gain effect of the particular electromagnetic pickup at the specific pickup height.

Figure 12:
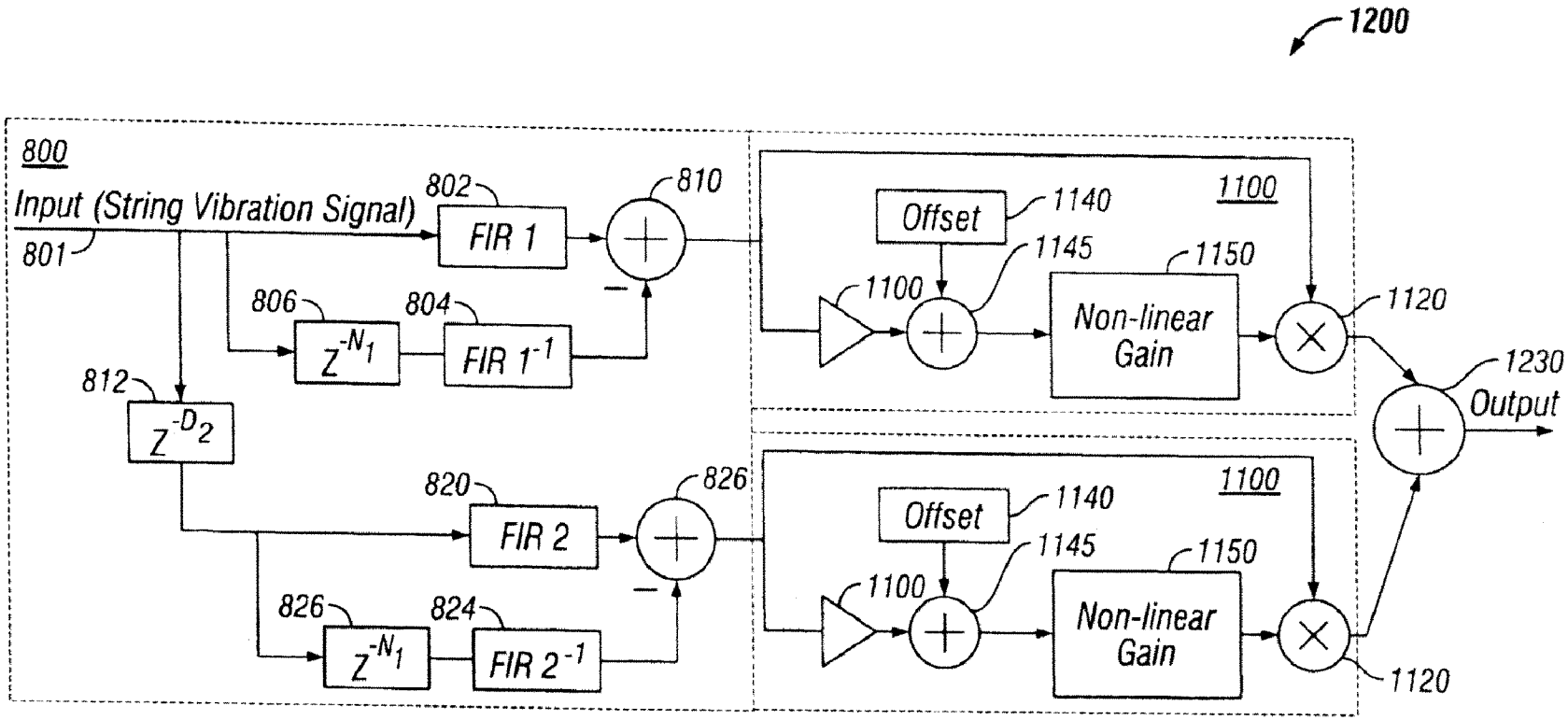
FIG. 12 shows a complete two dimensional example of a generalized block diagram of a DSP algorithm for emulating two electromagnetic pickups located at particular x (horizontal) locations and at particular y (pickup height) displacements along the string of a guitar of a particular guitar to be emulated and further including implementing non-linear gain modeling of the string, according to one embodiment of the present invention.

With reference now to FIG. 12, FIG. 12 shows a complete two dimensional example of a block diagram of a DSP algorithm 1200 for emulating two electromagnetic pickups located at particular x (horizontal) locations and at particular y (pickup height) displacements along the string of a guitar of a particular guitar to be emulated and further including implementing the previously described non-linear gain modeling of a string. As shown in FIG. 12, a input digital string vibration signal 801 for the string enters the DSP block diagram 800. It should be appreciated that DSP block diagram is a representation of the digital transfer function for the emulation of a guitar string of a desired guitar to be emulated with the particular configuration of electromagnetic pickups, previously discussed. However, this DSP block diagram can be generalized to any string of any guitar having two electromagnetic pictures, or any other stringed instrument.

By way of illustration, the input digital string vibration signal 801 is processed by FIR1 802 emulating the magnetic aperture filter response for a first electromagnetic pickup in response to an initial vibration signal and by FIR$1^{-1}$ 804 which is the inverse of FIR1 representing the magnetic aperture filter response for electromagnetic pickup in response to the reflected vibration signal (i.e. reflected from the bridge). Further, the input digital vibration signal is delayed by $z^{-N}{}_1$ 806 such that the reflected vibration signal is emulated as being delayed by $N_1$ samples. Moreover, the initial and reflected magnetic aperture FIR responses of FIR1 802 and FIR$1^{-1}$ 804 to the input vibration signal 801 are then summed with adder 810 to generate a first emulated digital string vibration signal of the first emulated electromagnetic pickup.

Similarly, after the input vibration signal 801 is delayed by $z^{-D}{}_2$ 812 such that the response of the second electromagnetic pickup, which is closer to the bridge, is properly delayed relative to the response of the first electromagnetic pickup farthest from the bridge, the input digital string vibration signal 801 is processed by FIR2 820 emulating the magnetic aperture filter response for the second electromagnetic pickup in response to the initial vibration signal and by FIR$2^{-1}$ 824 which is the inverse of FIR2 representing the magnetic aperture filter response for second electromagnetic pickup in response to the reflected vibration signal (i.e. reflected from the bridge). Further, the delayed input vibration signal from the output of delay 812 is delayed by $z^{-N}{}_2$ 826 such that the reflected vibration signal is modeled as being delayed by $N_2$ samples. Moreover, the initial and reflected magnetic aperture FIR responses of FIR2 820 and FIR$2^{-1}$ 824 to the input vibration signal 801 are then summed with adder 826 to generate a second emulated digital string vibration signal of the second emulated electromagnetic pickup.

Now both the first and second emulated digital string vibrations of the first and second emulated electromagnetic pickups, respectively, are each processed through DSP algorithm blocks 1100 to implement non-linear gain modeling of the string in relation to each electromagnetic pickup at its given pickup height, respectively. Both the first and second emulated digital string vibration signal of the first and second emulated electromagnetic pickups, are scaled by scaling block 1110, respectfully. Each of the first and second emulated digital string vibration signals of the first and second emulated electromagnetic pickups, respectively, are also each directly routed to multiplier block 1120. Particularly, the values of each of the first and second emulated digital string vibration signals of the first and second emulated electromagnetic pickups, respectively, are each converted to a scaled physical vibration distance amplitude, as previously discussed.

An offset from offset block 1140 is added by adder block 1145 to simulate the distance from the pickup height being modeled for each of the first and second emulated digital string vibration signals. This offset is added to the scaled physical vibration distance amplitude and provides the input to the non-linear gain lookup table 1150 to find a resultant non-linear gain that should be applied to properly emulate the non-linear distortion of the tone of the string in relation to the height of the particular electromagnetic pickup being modeled. A gain value is multiplied at multiplier block 1120 with each of the first and second emulated digital string tone signals of the first and second emulated electromagnetic pickups, respectively, to obtain first and second emulated digital string tone signals that are emulated as if they were both actually distorted by the real non-linear gain effect of the first and second electromagnetic pickups at their particular pickup heights, respectively.

Lastly, both the first emulated digital string tone signal of the first emulated electromagnetic pickup and the second emulated digital string tone signal of the second emulated electromagnetic pickup are summed by adder 1230 such that an emulated digital tone signal for the corresponding string of the desired guitar that the user has chosen to be emulated is created. This emulated digital tone signal emulates the string as detected by an electromagnetic pickup at a particular location relative to the string of the desired guitar in both the 'x' and 'y' directions including non-linear gain modeling. This emulated digital tone signal can then be converted to analog format and outputted to an amplifier which can then playback the emulated tone such that the guitar with embedded DSP modeling capabilities sound like the desired guitar chosen by the user.

Thus, a digital transfer function represented by combined DSP block diagram 1200 incorporating predetermined FIR filters having predetermined modeling coefficients, based on impulse responses of the modeled electromagnetic pickups, and calculated delays (DSP block diagram 800), and non-linear modeling in the 'y' axis by DSP block diagrams 1100 is created. This digital transfer function can be used emulate the output signal of the guitar string for the particular guitar chosen by a user in response to a digital input signal from a played string. In other words, based on a digital string vibration signal detected by the bridge, the digital signal processor 120 implementing the particular digital transfer functions (with predetermined modeling coefficients for the particular guitar to be emulated) of combined DSP block diagram 1200 can process the digital string vibration signal to emulate the corresponding string as detected by an electromagnetic pickup at a particular location relative to the string of the modeled guitar (which has a particular configuration of electromagnetic pickups previously modeled) to create an emulated digital tone signal that is modeled in both the 'x' and 'y' axis domains. This emulated digital tone signal can then be converted to analog format and outputted to an amplifier which can then playback the emulated tone such that the guitar with embedded DSP modeling capabilities 100 sounds like the guitar selected by the user. Again, as previously discussed, it should be appreciated by those skilled in the art that the above-described DSP algorithms are used to model pickup locations in two dimensions and that further processing is generally required to ultimately generate an output signal.

Although the previously described combined DSP block diagram 1200 illustrates only one particular example of a DSP block diagram for a guitar having two electromagnetic pickups for a particular guitar string, it should be appreciated by those skilled in the art that the previously described processes and methods of characterizing the guitar string as detected by an electromagnetic pickup at a particular location relative to the string of the guitar with a particular configuration of electromagnetic pickups (in both the 'x' and 'y' axis domains) can be done for any guitar string of any guitar having any number of electromagnetic pickup configurations and strings. Moreover, although described with reference to an electric guitar, it should be appreciated that utilizing the previous described methods and techniques, any stringed instrument can be modeled. Thus, any electrified stringed instrument can be modeled and then emulated utilizing the previously described processes and methods.

Therefore, using embodiments of the invention, a digital transfer function incorporating predetermined FIR filters having predetermined modeling coefficients, based on impulse responses of modeled electromagnetic pickups, and calculated delays, can be created for any guitar or stringed instrument having a given configuration of electromagnetic pickups and any number of strings, and further non-linear gain can be applied to further emulate the non-linear distortion effects of particular electromagnetic pickups at particular pickup heights. Accordingly, a digital transfer function and corresponding DSP block diagram model can be created and used to emulate a output signal for any guitar or stringed instrument in response to a digital input signal from a played string. In other words, based on a digital string vibration signal detected by the pickup, the digital signal processor 120 implementing a particular digital transfer function can process the digital string vibration signal to emulate a corresponding string tone of a desired guitar (in both the 'x' and 'y' axis domains) that the user has chosen to be emulated to create an emulated digital tone signal of the selected guitar. This emulated digital tone signal can then be converted to analog format and outputted to an amplifier which can then playback the emulated tone such that the guitar with embedded DSP modeling capabilities sounds like the desired guitar chosen by the user. Moreover, the embedded DSP allows for the modeling of any stringed instrument, e.g., acoustic guitars, mandolins, basses, etc. For example, in the case of acoustic instruments, standard techniques utilized to model the body resonances of acoustic instruments can be utilized. One such example is the acoustic modeling techniques disclosed in "More Acoustic Sounding Timbre from Guitar Pickups" by Karjalainen, Penttinen, and Valimaki, presented at the Proceedings of the $2^{nd}$ COST G-6 Workshop on Digital Audio Effects (DAFx99), NTNU, Trondheim, Dec. 9-11, 1999, hereby incorporated by reference.

Another embodiment of the invention relates to a stringed instrument with embedded digital signal processing (DSP) modeling capabilities that simulates the sounds of acoustic stringed instruments, such as, various types of acoustic guitars. The processing electronics are integrated into the stringed instrument itself and the stringed instrument with embedded digital signal processing (DSP) modeling capabilities achieves a high level of sonic accuracy and realism in the modeling of acoustic stringed instruments.

Particularly, the embodiments of the invention related to emulating the sound characteristics of acoustic stringed instruments may be implemented in the previously described stringed instrument 100 with embedded digital signal processing (DSP) modeling capabilities of FIG. 1. With brief reference again to FIG. 1, FIG. 1 shows a front view of a stringed instrument 100 with embedded DSP modeling capabilities having a body 102 and a plurality of strings 106.

In this embodiment, the stringed instrument 100 has six strings and is a guitar and is directed to modeling the sound characteristics of various acoustic stringed instruments, such as a variety of different acoustic guitars. However, it should be appreciated that the stringed instrument 100 may be used to model any type of acoustic stringed instrument, such as, a mandalin, a banjo, a bass, a violin, a sitar, a ukulele, etc. The acoustic embodiment of the invention will be hereinafter described and may be implemented in the previously described stringed instrument 100. A complete description of the structure and functionality of the stringed instrument 100 of FIG. 1 has been previously described in detail and will not be repeated for brevity's sake.

Of particular interest, it should be noted that a desired acoustic stringed instrument may be selected by a user and then emulated. Particularly, the user interface 130 located on the body 102 of the stringed instrument 100 may be utilized by the user for the selection of one or a plurality of different types of acoustic stringed instruments for modeling. A control processor is coupled to the user interface to provide modeling coefficients from a memory to the digital signal processor 120 for the particular acoustic stringed instrument selected by the user to be emulated and played.

Further, in the acoustic modeling guitar embodiment of the invention (i.e. where the stringed instrument 100 is a guitar), a plurality of different types of acoustic guitars are selectable by the user. For example, classic types of acoustic guitars that have associated classic "sounds" or tones may be emulated including various types of brands of acoustic guitars such as MARTIN, IBANEZ, TAYLOR, etc., as well as various types of configurations of these acoustic guitars: steel string, nylon string, hollow body, semi-solid body, etc.

As with the previously described embodiment of the invention directed to modeling electrical stringed instruments, the present embodiment directed to emulating acoustic stringed instruments is advantageous in that the digital signal processor 120 is contained within the stringed instrument 100 so that extra equipment such as detached processing units for DSP processing in between the stringed instrument 100 (hereinafter guitar 100) and an amplifier are not necessary.

Of particular note, as to the acoustic guitar embodiment 100, the user interface 130 similarly includes a volume knob 132 to adjust the volume of the guitar 100, a tone knob 134 to adjust the tone of the guitar 100, and a guitar selector knob 136. The guitar selector knob may be utilized to select the type of acoustic guitar (or other type of acoustic stringed instrument) to be emulated. For example, the guitar selector knob 136 can be moved to a plurality of different positions to choose a plurality of different types of acoustic guitars to be emulated. As one example, the guitar selector knob can be moved to a plurality of different positions to select a variety of different types of MARTIN brand acoustic guitars, a variety of different types of IBANEZ acoustic guitars, as well as, a variety of other different types of acoustic guitars or other types of acoustic stringed instruments.

Similarly, the embodiments of acoustic modeling guitar 100 may also be described with reference to previously discussed FIG. 2. In this embodiment, FIG. 2 is a block diagram 200 illustrating functional blocks of a stringed instrument with embedded DSP modeling capabilities, directed to the modeling of acoustic stringed instruments. As previously discussed with reference to FIG. 2, the functional blocks include the user interface 130, a control processor 205, digital signal processor 120, memory 210, digital to analog (D/A) converters 215, and a plurality of analog to digital (A/D) converters 220. The polyphonic pickup 110 is coupled to the plurality of A/D converters 220 and the A/D converters 220 are each respectively coupled to the digital signal processor 120. In this example, there are six A/D converters, one for each string of the acoustic modeling guitar 100.

As previously described, the polyphonic pickup 110 is used to detect the vibration signal of each string (i.e. when a string is played by a musician). The detected vibration signal of the string is then coupled to a respective A/D converter 220. The respective A/D converter 220 converts the detected vibration signal of the string into a digital string vibration signal and couples the digital string vibration signal to the digital signal processor 120.

The digital signal processor 120 then processes the digital string vibration signal. Particularly, the digital signal processor 120 is used to process the digital stringed vibration signal such that the corresponding string tone of the selected acoustic guitar is properly emulated based on pre-determined modeling coefficients for the selected acoustic guitar stored in memory 210.

The control processor 205 provides the proper pre-determined modeling coefficients from memory 210 to the digital signal processor 120 for the particular acoustic guitar selected by the user to be emulated. In this way, the digital signal processor 120 performs the proper transformations on the digital string vibration signal to properly emulate the corresponding sonic qualities of the particular acoustic guitar chosen by the user to be played. As will be discussed hereinafter, various types of filtering and modeling coefficients are applied to the digital string vibration signal in order to realistically emulate the desired acoustic guitar.

It also should be noted that all of the various types of filters, modeling systems, and processing to be hereinafter discussed in detail are based on pre-determined modeling coefficients and parameters that have been previously determined for each selected acoustic guitar to be emulated based on prior testing and modeling and these values have then been programmed to memory for subsequent use.

The emulated digital acoustic signal is then converted to analog form by D/A converter 215 to create an output emulated analog acoustic tone signal for output to an amplification device. For example, the emulated analog acoustic tone signal can be transmitted from the guitar 100 to an amplifier (not shown) utilizing a standard guitar cable.

It should be appreciated that the functional blocks 200 of the acoustic stringed instrument with embedded DSP modeling capabilities (e.g. guitar 100) are basically the same as those previously described with reference to the electric guitar embodiment. Therefore, the previous description of FIG. 2 as to the electric guitar embodiment applies equally to the acoustic modeling guitar 100 as well. Thus, much of that description will not be repeated for brevity's sake. The acoustic modeling guitar embodiment 100 utilizes DSP 120, control processor 205, memory 210, etc. in order to implement filtering utilizing modeling coefficients in order to faithfully replicate selected acoustic stringed instruments with a high degree of sonic accuracy and realism. This filtering and modeling will be described hereinafter in more detail.

Similar to the electric stringed instrument embodiment, the acoustic stringed instrument embodiment utilizes a control processor 205 and digital signal processor 120 that may operate under the control of software and/or firmware modules that are booted into memory for execution when the acoustic modeling guitar 100 is powered-on or reset. The software and/or firmware modules typically include programs that allow for the selection of a desired acoustic guitar to be emulated by the user and further control the selection and implementation of the correct modeling coefficients for digital signal processing and filtering on input digital vibration signals from the user such that the desired acoustic guitar instrument sounds are properly emulated.

Figure 13:
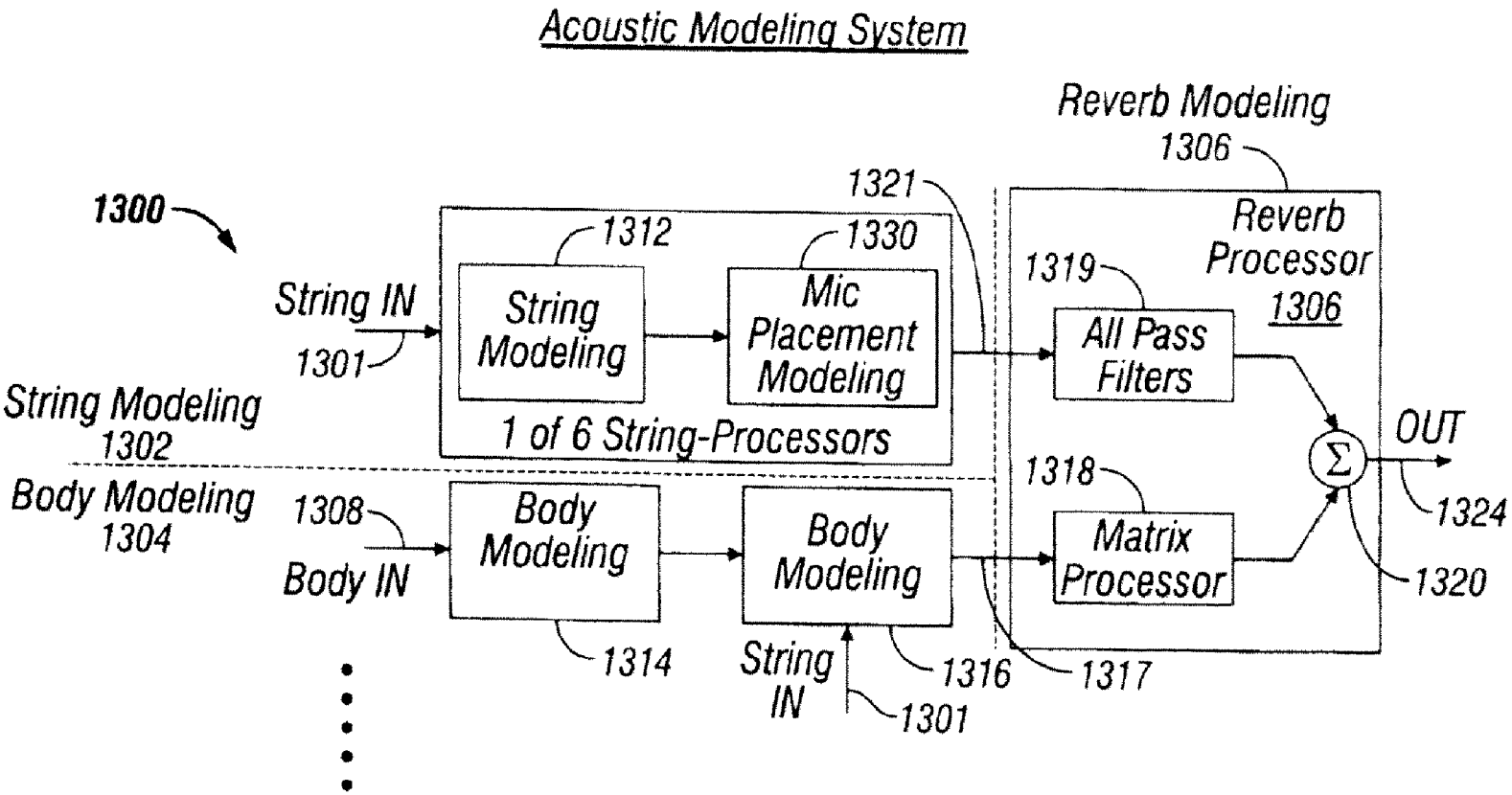
FIG. 13 is a block diagram of an acoustic modeling system for implementation within the acoustic modeling guitar, according to one embodiment of the invention.

With reference now to FIG. 13, FIG. 13 is a block diagram of an acoustic modeling system 1300, according to one embodiment of the invention. Particularly, the acoustic modeling system 1300 implements a variety of modeling stages in order to accurately model an acoustic stringed instrument or guitar. It should be appreciated that the following description of the modeling and filtering of string and body components to accurately emulate an acoustic stringed instrument may be implemented in the previously described acoustic stringed instrument 100 as previously described with reference to FIGS. 1 and 2. Hereinafter, the acoustic stringed instrument will be referred to as an acoustic modeling guitar, however, the techniques of the invention hereinafter described may be applicable to any acoustic stringed instrument.

As shown in FIG. 13, the acoustic modeling system 1300 implements string modeling 1302, body modeling 1304, microphone placement modeling 1330, and reverb modeling 1306 responsive to both a string input 1301 and a body input 1308 in order to accurately emulate a selected acoustic guitar. Particularly, string input 1301 is the digital input string vibration signal that is the result of a user picking a string of the acoustic modeling guitar 100.

The body input signal 1308 identifies the body of the acoustic stringed instrument selected by the user to be emulated via the user interface. Based on this body input signal 1308, particular body modeling coefficients 1314 are selected for use in body modeling 1316.

Basically, embodiments of the invention relate to an acoustic modeling guitar 100, with embedded digital signal processing (DSP) modeling capabilities, to model an acoustic guitar. As previously discussed, the acoustic modeling guitar includes a body and a plurality of strings and a pickup to which each string is coupled wherein the pickup detects a vibration signal of each string. Further, the acoustic modeling guitar includes an analog to digital converter to convert the detected vibration signal of a string into a digital string vibration signal.

The digital signal processor located within the body of the acoustic modeling guitar implements acoustic modeling system 1300 to process the digital string vibration signal (string IN 1301) to emulate a corresponding string tone of one or a plurality of acoustic guitars selected by a user resulting in output emulated acoustic digital string signal 1324. The output emulated acoustic digital string signal 1324 may then be converted to analog form to create an emulated analog acoustic string signal for output via a standard guitar cable to an amplification device.

As previously discussed, the user interface located on the body of the acoustic modeling guitar allows a user to select one or a plurality of acoustic guitars to be emulated. The control processor coupled to the user interface may provide modeling coefficients from memory to the digital signal processor for implementation in the acoustic modeling system 1300 to accurately model the acoustic guitar selected by the user.

As will be discussed, the emulation of a corresponding string tone for a selected acoustic guitar to be emulated includes body modeling 1316 in which a body of the acoustic guitar is emulated and filtering is applied to the digital string vibration signal 1301 based on a model of the body of the acoustic guitar to be emulated. The body modeling of the acoustic guitar may include modeling the body of the acoustic guitar as a bandpass filter based on the mechanical impedance of the soundboard of the body of the acoustic guitar to be emulated and filtering the digital string vibration signal with the bandpass filter. In one embodiment, the bandpass filter used to model the mechanical impedance may be a multi band parametric equalization filter.

Further, body modeling 1316 of the acoustic guitar may further model the relationship of the string to the soundboard of the body of the acoustic guitar to be emulated based on the mechanical admittance of the string to the soundboard measured at the bridge and filtering the digital string vibration signal based on the mechanical admittance.

The emulation of a corresponding string tone of an acoustic guitar may further include microphone placement modeling 1330 in which the digital string vibration signal (string input 1301) is filtered to emulate the string tone being processed through a stationary microphone. As will be discussed, this may include filtering the digital string vibration signal with a comb filter having a randomly varying delay.

Also, in one embodiment, the string tone for a selected acoustic guitar may further include modeling the sound of pick hitting a string. As will be discussed, in order to model the sound of a pick hitting a string, the filtering of the digital string vibration signal in string modeling 1312 may include adding a dynamic equalizer to boost high-frequency energy for short periods of time to model the sound of a pick hitting a string.

It also should be noted that all of the various types of filters, modeling systems, and processing to be hereinafter discussed in detail are based on pre-determined modeling coefficients and parameters that have been previously determined for each selected acoustic guitar to be emulated based on prior testing and modeling and these values have then been programmed to memory for subsequent use.

It should also be appreciated that acoustic modeling system 1300 of FIG. 13 only shows the modeling of one played string (i.e. string input 1301), and that, typically, six played strings would be utilized with the acoustic modeling guitar 100. In that case the acoustic modeling system 1300 shown in FIG. 13 would be repeated six times, once for each string. However, for brevity's sake, only the modeling of one string is shown. Furthermore, it should be appreciated that the acoustic modeling system 1300 may be implemented in the acoustic modeling guitar 100 utilizing DSP 120, control processor 205, memory 210, etc., as previously discussed.

Thus, the acoustic modeling system 1300 is applied to each string to create a highly realistic sound for a selected acoustic guitar to be emulated by utilizing string and body modeling 1312 and 1316, microphone placement modeling 1330, and reverb modeling 1306, as will be discussed hereinafter. The acoustic modeling system 1300 provides a very high level of sonic accuracy and realism by implementing filtering and modeling techniques to emulate dynamic string and body interaction, random microphone movement, and pick-sound simulation.

Further, the acoustic modeling system 1300 implemented in the acoustic modeling guitar 100 provides immunity to feedback. Additionally, when the acoustic modeling system 1300 is implemented in the acoustic modeling guitar 100, a fully-integrated stand-alone acoustic modeling guitar with on-board DSP processing is provided that renders a previously unattained level of sonic accuracy and realism while being fully portable and easy to use and only requires being plugged in to an amplifier to play.

String modeling 1302 will now be particularly discussed. Each digital input vibration string signal 1301 undergoes string modeling 1312. String modeling 1312 is typically performed by well known string equalization techniques.

Basically, for the selected acoustic guitar to be emulated, each string of the corresponding acoustic guitar to be emulated has a complicated frequency response. The frequency responses for strings of specific guitars are previously determined and modeled and modeling coefficients to re-create the frequency response utilizing DSP processes are stored in memory. Particularly, the frequency response for each string is emulated by string modeling 1312 by utilizing pre-determined modeling coefficients and DSP processing such that the played string of the acoustic modeling guitar, i.e., digital string input vibration signal 1301, conforms to the model frequency response for the given string of the acoustic guitar to be emulated. Such string modeling frequency responses are well known in the art.

Typically, there will be one to six string inputs 1301, which are digital string input vibration signals, based on a user playing the acoustic modeling guitar 100, each of which undergoes string modeling 1312 to accurately model the corresponding strings of the acoustic guitar to be emulated.

Further, for the acoustic guitar selected to be emulated, body modeling 1316 is also applied. In one embodiment, body modeling 1316 applies a tunable parametric equalization filter that has been previously determined to accurately model the mechanical impedance of the soundboard of the selected acoustic guitar. It should be noted that the soundboard refers to the front face of the acoustic guitar. Further, the frequency responses for soundboards of a plurality of different types of acoustic guitars are previously modeled and body modeling coefficients 1314 corresponding thereto are stored and selected based on the body input signal 1308. The body input signal 1308 corresponds to the selected acoustic guitar to be emulated and these body modeling coefficients 1314 are transmitted to body modeling process 1316.

These body modeling coefficients 1314 are utilized by body modeling process 1316 to re-create the frequency response of the soundboard utilizing DSP processes. More particularly, body input signal 1308 corresponds to the acoustic guitar selected to be modeled by the user (e.g. by the user interface), which in turn, selects particular parametric equalization filters for use in re-creating the frequency response of the soundboards in body modeling process 1316. In one embodiment, a 12-band parametric equalization filter is utilized to reconstruct the frequency response of the soundboard.

The tunable 12-band parametric equalization filter has been found to suitably model the mechanical impedance of the soundboard of an acoustic guitar. Basically, the mechanical impedance of the soundboard may be modeled as a suspension system, and more particularly, as a parallel second order response system, such that the soundboard may be modeled as a classical spring-mass mechanical system and/or a resistance-inductance-capacitance (RLC) equivalent circuit. Thus, the mechanical impedance of the soundboard may be accurately modeled by a tunable multi band parametric equalization filter.

Body modeling processing 1316 also receives digital string input vibration signal 1301 and based upon the selected multi band parametric equalization filter for the soundboard of the acoustic guitar to be emulated applies the parametric filter (i.e. bandpass filter) to the inputted digital string input signal 1301 to bandpass filter the input. In this way, certain frequencies are selected to aid in body modeling. As a result body modeled digital signal 1317 is transmitted to reverb processor 1307 for reverb modeling.

Both the digital string acoustic input signal 1301 after processing by string modeling 1312 (previously discussed) and after microphone placement modeling 1330 (as will be hereinafter discussed) and body modeled digital signal 1317 from body modeling processing 1316 are both subjected to reverb modeling 1306 by a reverb processor 1307 and combined at summer 1320. The resultant output 1324 is a digital composite acoustic output signal that has been processed to emulate particular qualities of a selected acoustic guitar, the particular acoustic characteristics of the body of the acoustic guitar, as well as string interaction with the body, microphone placement modeling, pick-sound modeling, as well as other modeling, that will be hereinafter described. This modeled digital output signal 1324 is then converted to analog form and outputted from the acoustic modeling guitar to an amplifier or other device for playback to the user.

In the reverb processor 1307 the body modeled digital signal 1317 is injected into parallel delay lines constituting a matrix reverb processor 1318. The parallel delay lines provide delay looping to add reverb to the body modeled digital signal 1317. In this implementation, the reverb delays are selected to be relatively short to reproduce the volume and shape of a specific acoustic guitar body as opposed to simulating the volume of an entire room.

Further, the digital string signal 1321 undergoes reverb modeling 1306 by reverb processor 1307 by being processed through a series of all pass filters 1319. These two signals that have been subjected to reverb modeling are summed at summer 1320 to produce an output digital acoustic string signal that has been digitally modeled and filtered to emulate a particular string of a particular type of acoustic guitar including such factors as the acoustic guitar's body, microphone simulation and the string's interaction with the guitar's body.

In one embodiment, the acoustic modeling system 1300 also provides for microphone placement modeling 1330. This type of modeling models the characteristic sound produced by a performer's movement relative to a stationary microphone attached to or located near the guitar. This can be effectively modeled by utilizing various digital signal processing (DSP) techniques, as will be discussed.

In one embodiment, a comb filter may be utilized to implement the modeling of the sound produced by a performer's movement of an acoustic guitar relative to a stationary microphone.

Figure 14:
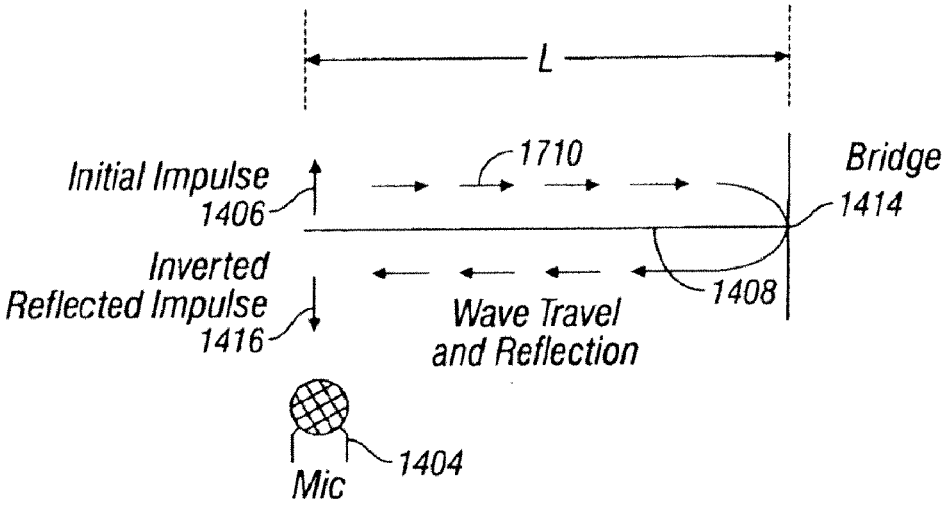
FIG. 14 is a diagram depicting the physics of microphone placement modeling and particularly illustrates how sound impulses are presented to a stationary microphone.

In order to illustrate these microphone placement modeling techniques, FIG. 14 is a diagram depicting the physics of microphone placement modeling and particularly illustrates how sound impulses are presented to a stationary microphone 1404.

The initial impulse, depicted by the vertical upward pointing arrow 1406, is produced when the performer plucks or strums a particular string 1408. The horizontal arrows 1410 depict the sound wave traveling the length (L) of the string 1404 and being reflected at the bridge 1414 and traveling back down the length of the string and eventually arriving at the microphone 1404 out-of-phase from the initial impulse 1406. This reflection of the sound wave may be modeled utilizing a comb filter. Further, in one embodiment of the invention, the delay implemented by the comb filter is dynamically varied, which has the effect of appearing to move the acoustic guitar around a stationary microphone thereby producing a convincing random microphone movement effect that realistically emulates how an acoustic guitar and/or performer move relative to a stationary microphone.

Figure 15:
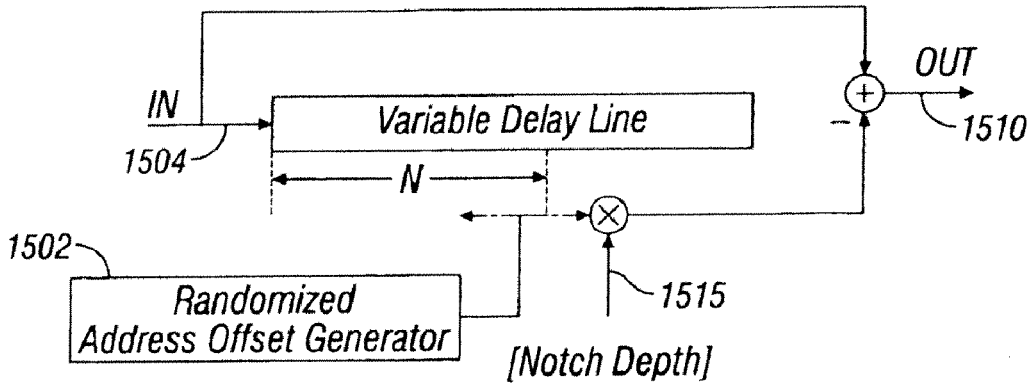
FIG. 15 is a block diagram illustrating an example of how a randomized address offset generator may be utilized in the acoustic modeling system, according to one embodiment of the invention.

In order to accomplish this, a randomized address offset generator may be utilized. With reference to FIG. 15, FIG. 15 is a block diagram illustrating an example of how a randomized address offset generator 1502 may be utilized in the acoustic modeling system, according to one embodiment of the invention.

Referring briefly back to FIG. 14, the microphone 1404 picks up a sound at a particular point along the length of the string 1408 to capture the initial impulse, which is reflected at the bridge 1414 and inverted, and appears to the microphone 1404 as an inverted impulse at a time (T). This time T is determined by the length (L) of the string and the wave speed (denoted as C). By taking the length L and dividing it by the wave speed C, the time delay between the positive impulse 1406 and its reflection in the opposite phase (i.e. inverted reflected impulse 1416) can be determined. This relationship may be expressed simply as:

$$T=L/C$$

Where C=(scale length)*(open string frequency)*2

With reference back to FIG. 15, the length of the delay N may be chosen to approximate T in terms of initial audio samples. However, in order to accomplish microphone placement modeling, the actual N value may be dynamically altered by the randomized address offset generator 1502 in order to provide continuous changes which are consistent with producing a realistic random-microphone effect.

As shown in FIG. 15, an input digital acoustic string signal 1504 may be varied by N along variable delay line 1506 responsive to a randomized address offset generator 1502. This input digital acoustic string signal that is varied along variable delay line 1506 may then be subtracted from the input digital acoustic string signal to produce an output digital acoustic string signal 1510 that has been randomized to approximate continuous changes consistent with the acoustic guitar being emulated being amplified by a stationary microphone and modeling the effect of a performer's movement relative to the stationary microphone.

Also, as shown in FIG. 15, a notch depth 1515 may also be introduced into this system. The notch depth 1515 is a predetermined coefficient for the particular acoustic guitar selected by the user. Notch depths are pre-determined and modeled to provide a more realistic sound for a particular microphone and acoustic guitar combination. As will be discussed, the notch depth effects the amplitude of the resulting signal.

Figure 16:
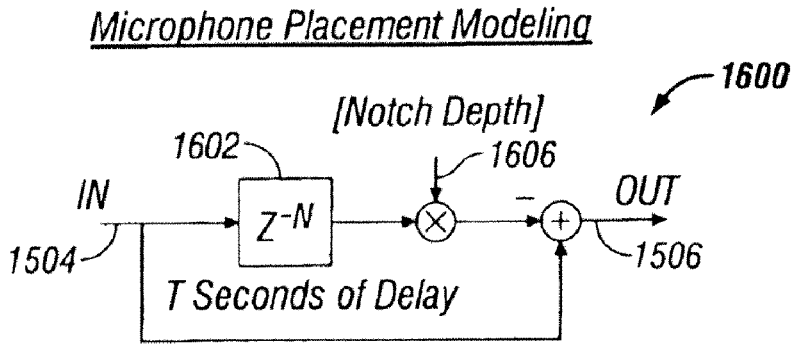
FIG. 16 is a block diagram illustrating a sample-based comb filter, according to one embodiment of the invention.

With reference to FIG. 16, FIG. 16 is a block diagram illustrating a sample-based comb filter 1600 where the delay time is a function of how many samples are stored to memory, according to one embodiment of the invention. T seconds of delay may be represented by memory bank 1602. Here the comb filter ($Z^{-N}$) delay may be varied by N which is dynamically altered utilizing the previously-discussed random address generation. In addition to varying the delays of the associated comb filters, the "notch" produced by the comb filters is also variable as shown by notch depth input 1606. Thus, the input digital acoustic string signal 1504 is randomized to model the effect of a performer's movement relative to a stationary microphone resulting in output digital acoustic string signal 1510.

Figure 17:
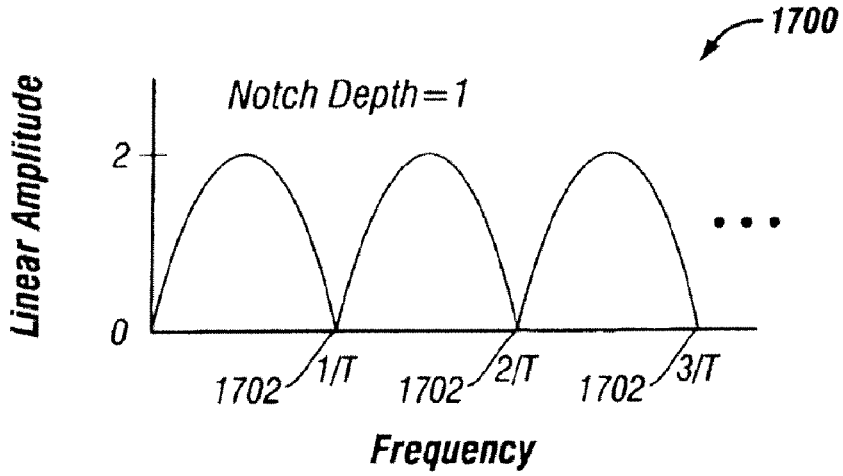
FIG. 17 is a graph showing linear amplitude versus frequency with a notch depth set to 1.

Turning to FIG. 17, FIG. 17 is a graph 1700 showing linear amplitude versus frequency with a notch depth set to 1, for an outputted digital acoustic string signal. As illustrated with a notch depth equal to 1, notches 1702 are shown at their respective delay times (1/T, 2/T, 3/T, etc.) in conjunction with their frequency relationship. Further, the linear amplitude gain is seen to vary between 0 and 2. The notches would theoretically be infinite, but in order to produce a convincing random microphone effect, in most cases, the magnitude of notches should be limited.

Figure 18:
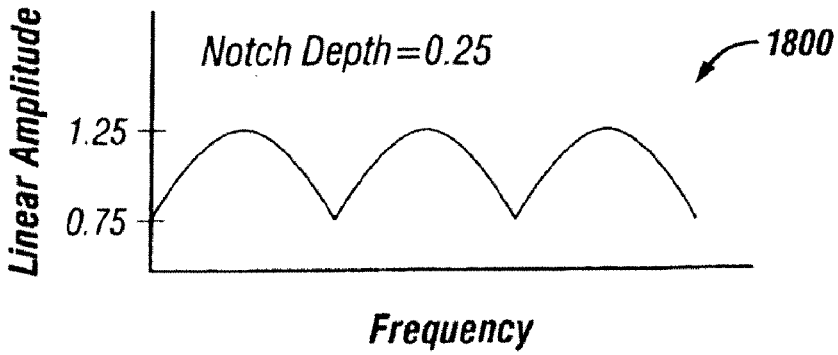
FIG. 18 is a graph showing linear amplitude versus frequency with a notch depth set to a value less than 1.

An example of this may be seen with reference to FIG. 18. FIG. 18 shows an example of a graph 1800 illustrating linear amplitude versus frequency with a notch depth set to a value less than 1, (e.g. notch depth coefficient is set to 0.25), for an outputted digital acoustic string signal. In this example, the linear amplitude varies between 0.75 and 1.25. This provides for a more realistic sounding acoustic guitar/microphone combination.

In one embodiment of the acoustic modeling system 1300, string modeling 1312 may also include digital signal processing in order to model the sound of a pick hitting a string. Although the acoustic modeling guitar provides a completely integrated system that has a bridge pickup to detect input digital signals from a picked string, unfortunately, the short percussive attacks commonly associated with a guitar pick hitting a string that are picked up by the microphone are not picked up by the bridge pickup. Thus, in order to preserve this desired characteristic and appealing sound quality, embodiments of the acoustic modeling guitar take this factor into account and actually model this feature.

Particularly, in real world terms, when striking a guitar string with a pick, or even with a performer's fingers, this initial attack creates a short high-frequency transient which a microphone faithfully captures, but a bridge pickup does not. In order to preserve this very noticeable characteristic, the acoustic modeling guitar monitors the energy levels at which the strings are attacked and adds a dynamic equalizer to boost high-frequency energy for short periods corresponding to the string attack. More particularly, by properly tuning an equalizer model, the high frequency bands similar to the frequency bands produced when a pick hits a string are increased. Thus, this approach can be used to replicate the percussive sound of a pick striking a string. This effect is useful for modeling the strumming of chords and for finger picking and adds a sense of realism for virtually every playing style.

Figure 19:
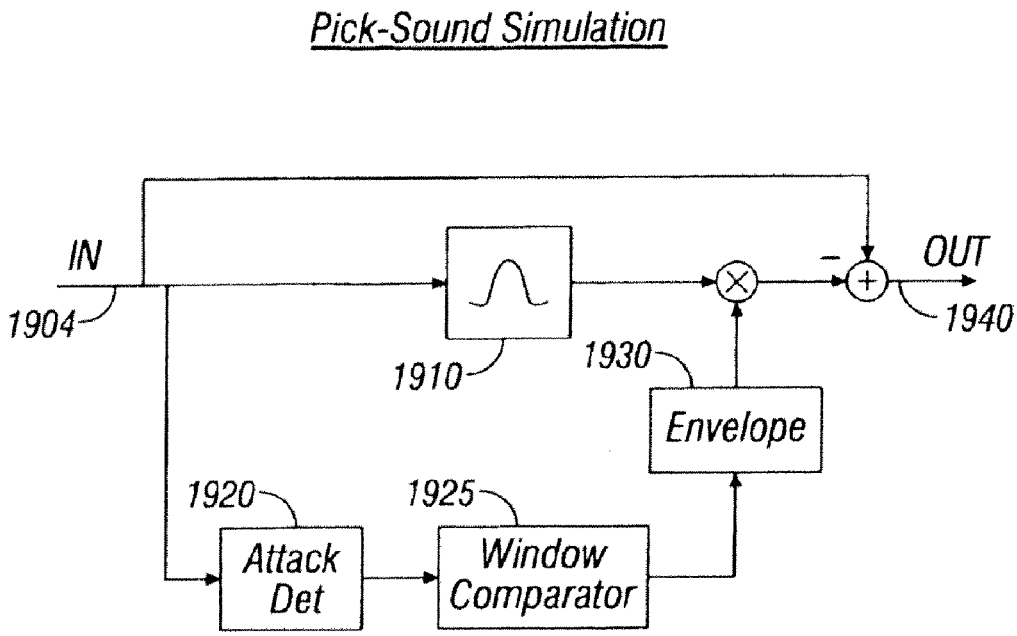
FIG. 19 shows a block diagram illustrating a pick-sound simulation system, according to one embodiment of the invention.

With reference to FIG. 19, FIG. 19 shows a block diagram illustrating a pick-sound simulation model, according to one embodiment of the invention. A digital acoustic string input signal 1904 is modified by an adjustable second order bandpass filter 1910. The output of the bandpass filter 1910 is conditionally modified dependent upon the activation of an attack dependent envelope generator 1920. To create the proper percussive sound, the bandpass filter 1910 is typically tuned to very high audible frequencies, for example, around 10K hertz (Hz), while its Q is fairly high (e.g., nominal values of Q around 10).

Figure 20:
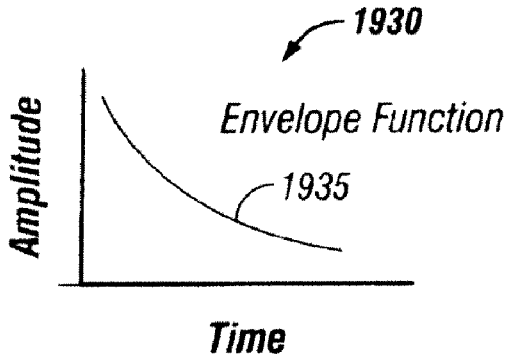
FIG. 20 is a graph illustrating an envelope function that consists of a first order decaying exponential.

The attack detector 1920 works in conjunction with a specialized window comparator 1925 to impose realistic envelopes on the bandpass filter's 1910 gain. In one embodiment, the window comparator 1925 may impose an envelope 1930 that consists of a first order decaying exponential. For example, as shown in FIG. 20, an envelope function 1930 may be seen that consists of a first order decaying exponential 1935, with typical decay times ranging, for example, from 20 to 100 milliseconds (ms).

There are typically two factors that dictate the sensitivity and effectiveness of envelope triggering. One is window length and the other is amplitude magnitude. Once an attack has been recognized by the attack detector 1920, a predetermined time window implemented by the window comparator 1925 must expire before acknowledging any additional prospective trigger events.

In addition, the recorded attack must be of sufficient magnitude, typically a factor of 2× higher than the last recognized peak in order to qualify as a new trigger event. This may be accomplished utilizing the window comparator 1925. However, if over a given window's duration, a new trigger event is not detected, then the window's highest recorded amplitude may be recorded as the "amplitude value of record," for which the next window is compared.

Thus, when a performer hits a string with sufficient force such that the attack detector 1920 recognizes an attack and further the window comparator 1925 recognizes an attack, the envelope 1935 function may be applied to the output of the bandpass filter 1910. In this way, the percussive of sound a pick hitting a string is added to input digital string signal 1904 and is accurately replicated in output digital string signal 1940.

Further, in one embodiment of the acoustic modeling guitar, additional body modeling 1316 for the acoustic modeling system 1300 may also be provided to cover an important sound characteristic relating to how strings interact with the soundboard of a particular acoustic guitar. This type of modeling may be referred to as dynamic string-tone modeling or filtering. The additional body modeling incorporating dynamic string-tone filtering provides a very high degree of realism in acoustic guitar modeling.

The primary purpose of dynamic string-tone filtering is to accurately simulate the evolving tonality of a string of a particular selected acoustic guitar to be emulated as it interacts with the specific soundboard of the particular selected acoustic guitar and the movement at the bridge, both of which are functions of the selected acoustic guitar body. It is important to note that in dynamic string-tone filtering, each string is considered separately, and that the string/soundboard relationship evolves over time.

In order to accurately model and quantify the relationship of the string to the soundboard, the mechanical admittance of the system, measured at the bridge, is characterized as:

$$\text{Admittance}=\text{velocity}/\text{force}.$$

It should be noted that for any guitar body (or for that matter any stringed instrument body), at a given frequency, that applying a specific amount of force (wherein the string force is transferred to the soundboard via the bridge) results in a specific sound board velocity.

For example, an acoustic guitar body (e.g., a hollow body) has a much higher velocity than does a solid body. Looking at a theoretical case for a solid body, if the body and bridge were infinitely rigid, at a given frequency, ideally, that frequency would have infinite sustain. Conversely, a string's energy decays most rapidly at those frequencies where the body exhibits the greatest admittance (i.e., where its motion is largest). At these frequencies, the energy is depleted from the string at a comparatively higher rate than those frequencies exhibiting less admittance, hence the affected frequencies have limited sustain.

Each type of acoustic guitar body has a unique and dynamic relationship in how the strings react to and interact with the soundboard. As will be discussed, embodiments of the invention related to dynamic string-tone filtering accurately model the crucial aspects of this interaction between the string and the soundboard.

Figure 21:
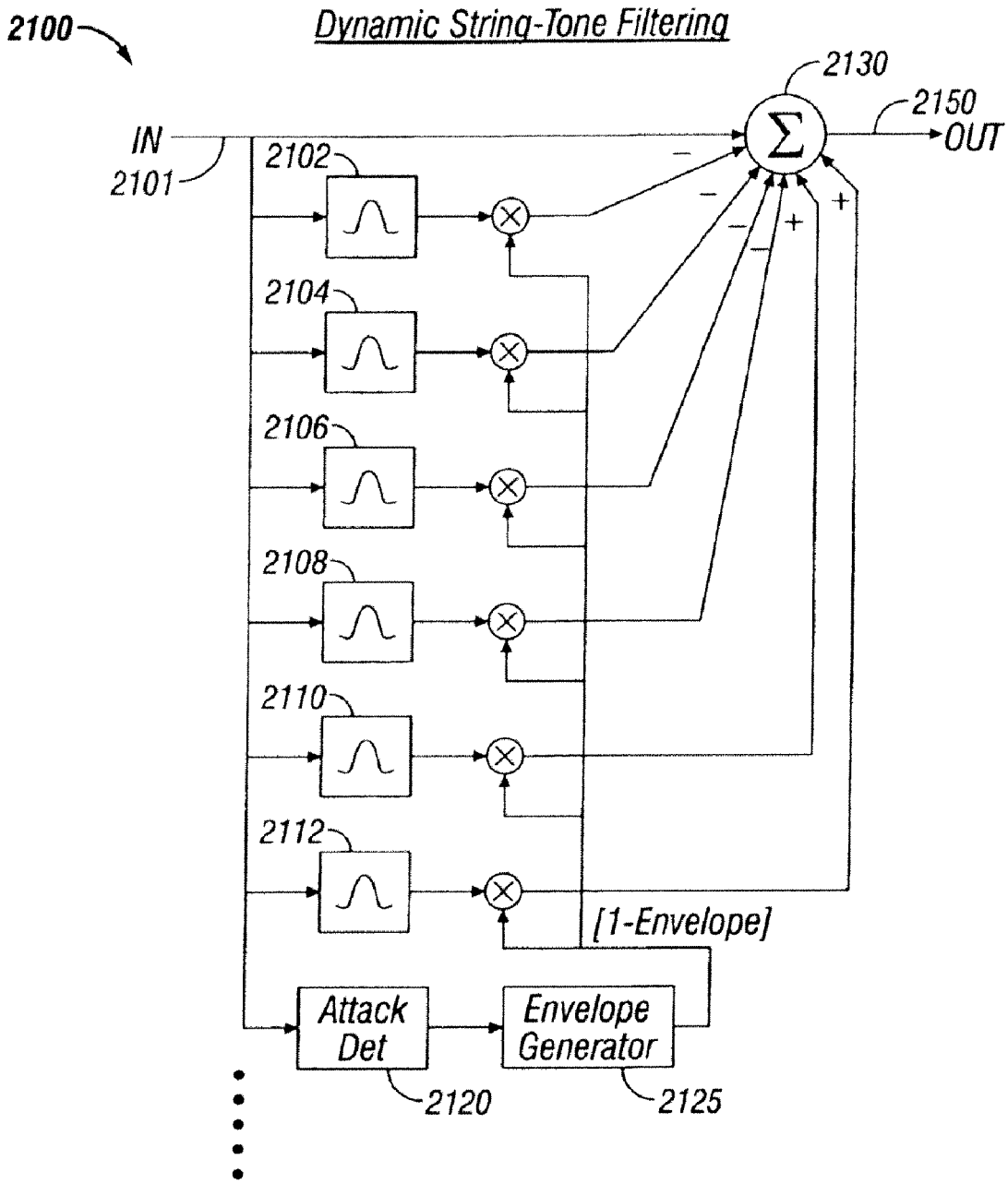
FIG. 21 is a block diagram illustrating the components of a dynamic string-tone filtering system, according to one embodiment of the invention.

With reference to FIG. 21, FIG. 21 shows a block diagram illustrating the components of a dynamic string-tone filtering system 2100, according to one embodiment of the invention. It should be noted that the dynamic string-tone filtering system 2100 for brevity's sake only shows dynamic string-tone filtering as applied to one string to illustrate how the string interacts with the body of the acoustic guitar and that dynamic string-tone filtering is typically applied to each of the six strings of a typical acoustic guitar to be modeled. Thus the dynamic string-tone filtering system 2100 would typically be repeated for each string of the acoustic guitar to be modeled.

In this embodiment, the dynamic string-tone filtering system 2100 utilizes a total of six stages of bandpass equalization 2102, 2104, 2106, 2108, 2110, and 2112. The first four bands of subtractive equalization 2102, 2104, 2106, and 2108 provide subtractive equalization to simulate the previously-described string-energy loss at specific frequencies. The two bands of additive equalization 2110 and 2112 are specifically designed to simulate the host acoustic guitar (e.g. the acoustic modeling guitar 100, previously discussed) body's low-admittance frequency bands, which require reinforcement for proper matching.

Dynamic string-tone filtering system 2100 as shown in FIG. 21 also utilizes an attack detector 2120 and an envelope generator 2125 both of which are similar to those utilized in the previously-described pick-sound simulation (e.g. see FIGS. 1920 and 1930), however they vary in a few aspects.

Particularly, the dynamic string-tone filtering system's envelope generator 2125 incorporates a timed "hold" prior to instigating an exponential decay. The envelope generator 2125 utilizes a single envelope generator to process each string on an individual basis but can be further extended as processing power permits. For example, each of the individual filters may have their own dedicated envelope generators to add higher levels of dynamic character.

The attack detector 2120 functions similarly to the attack detector 1920 discussed with reference to FIG. 19.

Figure 22A:
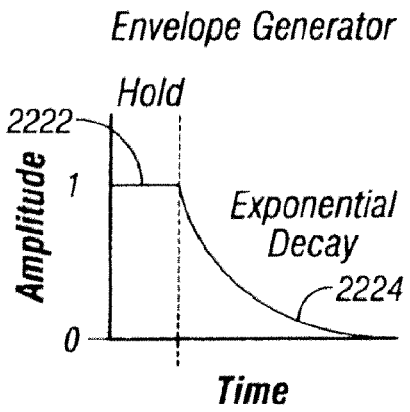
FIG. 22A is a graph illustrating an envelope generator function including a hold function.
Figure 22B:
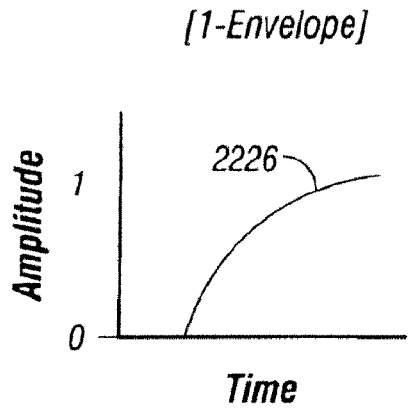
FIG. 22B illustrates the function [1-envelope].

Looking briefly at FIG. 22A, FIG. 22A illustrates the envelope generator function. Particularly, as seen in FIG. 22A the envelope generator 2125 imparts a hold function 2222 at an amplitude of "1" and then imparts an exponential decay that decays with time. Looking to FIG. 22B, FIG. 22B illustrates the function [1-envelope], this function curve 2226 is shown as a function of time rising between an amplitude of zero up towards an amplitude of "1".

Figure 23:
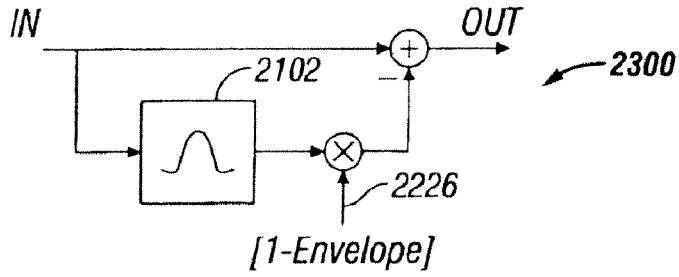
FIG. 23 is a graph showing a single stage of the dynamic string-tone filtering equalization system and demonstrates how the envelope increases the bandpass equalization filter's effect over time.

Turning now to FIG. 23, FIG. 23 shows a single stage 2300 of the dynamic string-tone filtering equalization system 2100 and demonstrates how the envelope increases the bandpass equalization filter's effect over time.

Figure 24:
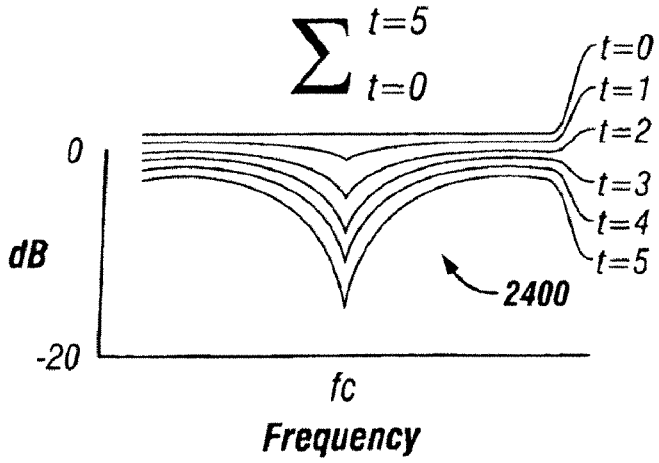
FIG. 24 is a graph showing resulting output responses as a function of time for the dynamic string-tone filtering system.

Looking to FIG. 24, FIG. 24 shows resulting output responses as a function of time for the dynamic string-tone filtering system, and specifically shows how the output responses 2400 evolve to match the dynamic admittance characteristics of a particular selected acoustic guitar when measured at a specific frequency (fc). As the output response curves 2400 show, the top curve, at t=0, i.e. the hold function, delays the filter effects for a predetermined time, and at a subsequent times t=1, t=2, t=3, t=4, and t=5, about frequency fc, the filter's effect gradually increases thereby decreasing the amplitude of the digital acoustic string output signal.

Thus, by implementing dynamic string tone filtering 2100, a digital string acoustic input signal 2101 from the acoustic modeling guitar that is sufficient enough to trigger attack detector 2120, undergoes four stages of subtractive bandpass equalization 2102, 2104, 2106, and 2108 (subtracted at summation block 2130) modified by the previously-described [1-envelope] function to simulate the string-energy loss at specific frequencies and further undergoes two stages of additive bandpass equalization 2110 and 2112 (added at summation block 2130) also modified by the previously-described [1-envelope] function to simulate the host acoustic modeling guitar body's low-admittance frequency band. The resultant digital string acoustic output signal 2150 is thereby modeled to accurately simulate the evolving tonality of the string as it interacts with the soundboard of the particular selected acoustic guitar and the movement at the bridge thereof.

Additionally, in one embodiment, the acoustic modeling guitar further includes integrated selectable custom tuning functionality as part of string modeling 1312.

Although there is a wide performance repertoire based on "standard tuning," there is also a large body of music based on "custom tuning" to suit various genres, tonalities, and timber. While "custom tuning" increases instrument versatility and performance possibilities, it also adds a high degree of complication due to the amount of time required to manually custom tune an acoustic guitar.

Further, because strings need a certain amount of time to "settle," it is very difficult to substantially change tuning without impacting the continuity of a given performance. In other words, since the strings take some time to become stable (i.e., retain accurate pitch after substantially changing tension), it becomes difficult and inconvenient to vary tunings during a given performance. Even if the performer waits for the strings to stabilize, which requires several minutes at best, there is still a tendency for the strings to continue a slow drift, or to slowly detune. In this case, the performer is required to retune the instrument, usually between each selection.

Other custom tunings require the use of mechanical devices such as capos, which, while not presenting string-settling problems, nonetheless impose pauses in the performance to replace and remove these devices.

Rather than by physically retuning the strings by altering their respective tension or by utilizing a capo, embodiments of the acoustic modeling guitar through the use of string modeling 1312 allow the performer to utilize sophisticated pitch detection and pitch shifting algorithms to change to virtually any tuning instantly. Unlike previously implementations, this is a fully integrated solution within the acoustic modeling guitar itself.

By utilizing the user interface previously discussed, a user can select from a variety of pre-programmed tunings that can be easily accessed at any time. Various pitch detection and pitch shifting algorithms to alter tunings are well known in the art and can be implemented in the integrated acoustic modeling guitar as part of string modeling 1312 and may be implemented in conjunction with DSP 120, control processor 205, and memory 210 of the acoustic guitar embodiment, as previously discussed. Advantageously, string settling no longer delays or compromises a performer utilizing the acoustic modeling guitar, and by having the system fully integrated into the acoustic modeling guitar a high level of convenience is achieved.

Moreover, as previously discussed, for both the electric guitar embodiment and the acoustic guitar embodiment, it should be appreciated that the control processor 205 provides the proper modeling coefficients from memory 210 to the digital signal processor 120 for the particular electric or acoustic guitar selected by the user to be emulated. In this way, the digital signal processor 120 may perform the proper transformations on the digital string vibration signal to implement the previously described electric and acoustic modeling systems and filtering algorithms, as previously discussed, to perform the proper transformations on the digital string vibration signal to properly emulate the corresponding string tone of the particular electric or acoustic guitar chosen to be played by the user.

The various aspects of the previously described inventions can be implemented as one or more instructions (e.g. software modules, programs, code segments, etc.) to perform the previously described functions. The instructions which when read and executed by a processor, cause the processor to perform the operations necessary to implement and/or use embodiments of the invention. Generally, the instructions are tangibly embodied in and/or readable from a machine-readable medium, device, or carrier, such as memory, data storage devices, and/or remote devices. The instructions may be loaded from memory, data storage devices, and/or remote devices into memory for use during operations. The instructions can be used to cause a general purpose or special purpose processor, which is programmed with the instructions to perform the steps of the present invention. Alternatively, the features or steps of the present invention may be performed by specific hardware components that contain hard-wired logic for performing the steps, or by any combination of programmed computer components and custom hardware components.

While the present invention and its various functional components have been described in particular embodiments, it should be appreciated the embodiments of the present invention can be implemented in hardware, software, firmware, middleware or a combination thereof and utilized in systems, subsystems, components, or sub-components thereof. When implemented in software (e.g. as a software module), the elements of the present invention are the instructions/code segments to perform the necessary tasks. The program or code segments can be stored in a machine readable medium, such as a processor readable medium or a computer program product, or transmitted by a computer data signal embodied in a carrier wave, or a signal modulated by a carrier, over a transmission medium or communication link. The machine-readable medium or processor-readable medium may include any medium that can store or transfer information in a form readable and executable by a machine (e.g. a processor, a computer, etc.). Examples of the machine/processor-readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A guitar with digital signal processing (DSP) modeling capabilities, the guitar having a body, a bridge assembly, and at least one string coupled to the bridge assembly, the guitar comprising:

a pickup to detect a vibration signal of the string;

an analog to digital converter to convert the detected vibration signal of the string into a digital string vibration signal; and a digital signal processor to process the digital string vibration signal to emulate a corresponding string tone of a string for a guitar selected by a user to be emulated wherein the emulation of the corresponding string tone for the string of the selected guitar includes the emulation of a location of an electromagnetic pickup relative to the string for the guitar selected to be emulated to create an emulated digital tone signal.

2. The guitar of claim 1, wherein the pickup is integrated into the bridge assembly.

3. The guitar of claim 2, wherein the pickup is a piezoelectric pickup.

4. The guitar of claim 1, wherein the pickup is not integrated into the bridge assembly.

5. The guitar of claim 4, wherein the pickup is a magnetic pickup.

6. The guitar of claim 1, wherein the creation of the emulated digital tone signal for the guitar to be emulated includes the digital signal processor processing, the digital string vibration signal utilizing a finite impulse response (FIR) filter having pre-determined modeling coefficients for the guitar to be emulated.

7. The guitar of claim 6, wherein, the emulated digital tone signal is converted to analog form to create an emulated analog tone signal for output to an amplification device.

8. The guitar of claim 6, further comprising a user interface located on the body of the guitar to allow a user to select one of a plurality of guitars to be emulated.

9. The guitar of claim 8, further comprising a control processor coupled to the user interface to provide pre-determined modeling coefficients from a memory to the digital signal processor for the guitar selected by the user.

10. The guitar of claim 1, wherein the emulation of the corresponding string tone for the emulated guitar further includes emulating a pickup height of the electromagnetic pickup.

11. The guitar of claim 10, wherein emulating the pickup height of an electromagnetic pickup includes applying a non-linear gain to model non-linear distortion associated with the pickup height of the electromagnetic pickup for the corresponding string tone of the emulated guitar.

12. A method of emulating a plurality of different guitars with a guitar having digital signal processing (DSP) modeling capabilities, the guitar having a body, a bridge assembly, and at least one string coupled to the bridge assembly, the method comprising:

detecting a vibration signal of at least one string utilizing a pickup;

converting the detected vibration signal of the string into a digital string vibration signal; and processing the digital string vibration signal to emulate a corresponding string tone of a string for a guitar selected by a user to be emulated wherein the emulation of the corresponding string tone for the string of the selected guitar includes the emulation if a location of an electromagnetic pickup relative to the string for the guitar selected to be emulated to create an emulated digital tone signal.

13. The method of claim 12, wherein the pickup is integrated into the bridge assembly.

14. The method of claim 13, wherein the pickup is a piezoelectric pickup.

15. The method of claim 13, wherein the pickup is not integrated into the bridge assembly.

16. The method of claim 15, wherein the pickup is a magnetic pickup.

17. The method of claim 12, wherein the creation of the emulated digital tone signal for the guitar to be emulated includes the processing the digital string vibration signal utilizing a finite impulse response (FIR) filter having pre-determined modeling coefficients for the guitar to be emulated.

18. The method of claim 17, wherein the emulated digital tone signal is converted to analog form to create an emulated analog tone signal for output to an amplification device.

19. The method of claim 17, further comprising allowing a user to select one of a plurality of guitars to be emulated with a user interface, the user interface being located on the guitar.

20. The method of claim 19, further comprising providing modeling coefficients from a memory for use in emulating the guitar selected by the user.

21. The method of claim 12, wherein the emulation of the corresponding string tone for the emulated guitar further includes emulating a pickup height of the electromagnetic pickup.

22. The method of claim 21, wherein emulating the pickup height of an electromagnetic pickup includes applying non-linear gain to model non-linear distortion associated with the pickup height of the electromagnetic pickup for the corresponding string of the emulated guitar.

* * * * *